US008281962B2

(12) United States Patent
Ogawa et al.

(10) Patent No.: US 8,281,962 B2
(45) Date of Patent: Oct. 9, 2012

(54) COATING CONTAINER

(75) Inventors: Yukihiro Ogawa, Ibaraki (JP); Hidenari Nishikura, Ibaraki (JP)

(73) Assignee: Taisei Kako Co., Ltd., Osaka (JP)

( * ) Notice: Subject to any disclaimer, the term of this patent is extended or adjusted under 35 U.S.C. 154(b) by 1044 days.

(21) Appl. No.: 12/225,806

(22) PCT Filed: Mar. 27, 2007

(86) PCT No.: PCT/JP2007/056475

§ 371 (c)(1),
(2), (4) Date: Sep. 30, 2008

(87) PCT Pub. No.: WO2007/114121

PCT Pub. Date: Oct. 11, 2007

(65) Prior Publication Data

US 2009/0173755 A1 Jul. 9, 2009

(30) Foreign Application Priority Data

Mar. 31, 2006 (JP) ..... 2006-100071

(51) Int. Cl.
*B65D 5/72* (2006.01)

(52) U.S. Cl. ..... 222/501; 222/503; 222/509; 222/161; 222/546; 222/549; 401/102; 401/108; 401/262; 215/329

(58) Field of Classification Search ..... 222/501–503, 222/509, 505, 322, 546, 549, 161, 619; 401/102–103, 107–108, 126–127, 262, 269; 215/211–221, 329, 354
See application file for complete search history.

(56) References Cited

U.S. PATENT DOCUMENTS 2,039,037 A * 4/1936 Simpson ..... 220/301
3,091,374 A * 5/1963 Schwartzman ..... 222/448
3,278,096 A * 10/1966 Miller ..... 222/521

(Continued)

FOREIGN PATENT DOCUMENTS

JP 3-69466 3/1991

(Continued)

OTHER PUBLICATIONS

Supplementary European Search Report issued Mar. 12, 2010 in Application No. EP 07 73 9913.

(Continued)

*Primary Examiner* — Kevin P Shaver
*Assistant Examiner* — Andrew P Bainbridge
(74) *Attorney, Agent, or Firm* — Wenderoth, Lind & Ponack, L.L.P.

(57) ABSTRACT

A tongue and groove arrangement guides an outer cap in an axial direction with respect to an inner cap. When a cap is fixed to a mouth of a container body, the outer cap is located in a direction of separating from the inner cap in the axial direction, and an inner face of a top wall of the outer cap is separated from a valve to urge the valve in a direction of projecting from a discharge hole of an inside plug, causing the discharge hole to close. When the cap is detached and removed from the mouth, the outer cap is moved in a direction of approaching the inner cap in the axial direction, and the inner face abuts the valve urged in a direction of separating from the discharge hole while resisting against an urging member, causing the discharge hole to open.

12 Claims, 20 Drawing Sheets

U.S. PATENT DOCUMENTS

| | | | | |
|---|---|---|---|---|
| 3,331,094 | A * | 7/1967 | Schwartzman | 401/269 |
| 4,164,307 | A * | 8/1979 | Imamura et al. | 222/182 |
| 4,378,077 | A * | 3/1983 | Akino | 222/182 |
| 4,461,408 | A * | 7/1984 | Shepard | 222/501 |
| 5,121,850 | A | 6/1992 | Morel | |
| 5,398,849 | A * | 3/1995 | Smith et al. | 222/235 |
| 5,713,493 | A * | 2/1998 | Garibaldi | 222/153.06 |
| 6,267,273 | B1 * | 7/2001 | Suzuki et al. | 222/505 |
| 6,997,359 | B2 * | 2/2006 | Boggs et al. | 222/520 |
| 7,461,650 | B1 * | 12/2008 | Rand | 128/200.23 |
| 2005/0139621 | A1 | 6/2005 | Foster | |

FOREIGN PATENT DOCUMENTS

| | | |
|---|---|---|
| JP | 9-66959 | 3/1997 |
| JP | 2000-272650 | 10/2000 |
| JP | 2003-160159 | 6/2003 |
| JP | 2004-90976 | 3/2004 |
| JP | 2004-306999 | 11/2004 |

OTHER PUBLICATIONS

International Search Report issued May 15, 2007 in the International (PCT) Application No. PCT/JP2007/056475.

* cited by examiner

Plug closed state

Plug opened state

Plug closed state

Plug opened state (A)

(B)

Plug closed state

Plug opened state

Plug closed state

Plug opened state

Plug closed state

Plug opened state

COATING CONTAINER

TECHNICAL FIELD

The present invention relates to a coating container provided with an inside plug member that is fixed to the mouth part of a container body for holding a liquid and that includes a valve element capable of opening and closing a discharge hole by a push system.

BACKGROUND ART

A coating container provided with an inside plug member that is fixed to the mouth part of a container body for holding a liquid and that includes a valve element capable of opening and closing a discharge hole by a push system has been used conventionally.

As shown in FIG. 16 for instance, for a coating container 100 of this kind in a push type, an inside plug member 106 is fixed to a mouth part 104 of a container body 102 for holding a liquid such as a liquid for a medical agent, a cosmetic liquid, and an industrial liquid.

The inside plug member 106 is provided with a valve element 112 that can project from and withdraw into a discharge hole 108 and that is urged in the direction of projecting from the discharge hole 108 by an urging member 110 in such a manner that the discharge hole 108 formed at the leading end of the inside plug member 106 is opened and closed. A cap member 114 is detachably fixed to the mouth part 104 of the container body 102.

For the coating container 100 of a push type, as shown in FIG. 16, a state in which the cap member 114 is fixed to the mouth part 104 of the container body 102 is kept in the case in which the coating container is not used.

In this state, the valve element 112 is urged by the urging member 110, and the discharge hole 108 of the inside plug member 106 is closed in such a manner that a liquid held in the container body 102 is prevented from leaking through the discharge hole 108.

In the case in which the coating container is used as shown in FIG. 17, the cap member 114 fixed to the mouth part 104 of the container body 102 is detached and removed, and the coating container is disposed upside down. A leading end of the valve element 112 projecting from the discharge hole 108 of the inside plug member 106 is then pressed to a section A to be coated.

By the above configuration, the valve element 112 is separated from the discharge hole 108 while resisting against the urging force of the urging member 110 to cause the discharge hole 108 to be opened, thereby coating the section A to be coated with a liquid held in the container body 102.

However, for the coating container 100 of a push type, in the case in which a liquid having a high volatility such as ethanol series is held in the container body 102, a liquid held in the container body 102 is gasified in some cases depending on an ambient temperature environment.

Consequently, as shown in FIG. 17, in the case in which the leading end of the valve element 112 projecting from the discharge hole 108 of the inside plug member 106 is pressed to a section A to be coated to cause the discharge hole 108 to be in the opened state, a liquid held in the container body 102 is discharged in quantity larger than the predetermined amount by an internal pressure of a gas in the container body 102, thereby preventing the coating from being carried out with precision. Moreover, by an influence of a gas, a discharged liquid is dispersed over the surrounding area and contaminates the section to be coated in some cases.

In consideration of such conditions, in Patent document 1 (Japanese Patent Application Laid-Open Publication No. 9-66959), a coating container 200 as shown in FIG. 18 is proposed.

More specifically, for the coating container 200 in accordance with Patent document 1, a pressing portion 216 is formed on the middle section inside the top wall of the cap member 214, and a valve element 212 is pressed down while resisting against the urging force of an urging member 210 in the state in which the cap member 214 is fixed to the mouth part 204 of the container body 202.

Moreover, a contact ring 218 is formed on the periphery of the pressing portion 216. Consequently, in the state in which the cap member 214 is fixed to the mouth part 204 of the container body 202, the contact ring 218 is abutted to the leading end peripheral part of an inside plug member 206, thereby preventing a liquid from leaking externally from the inside plug member 206.

By the above configuration, in the state in which the cap member 214 is fixed to the mouth part 204 of the container body 202, the pressing portion 216 of the cap member 214 presses the valve element 212 downward while resisting against the urging force of an urging member 210, thereby causing the discharge hole 208 of the inside plug member 206 to be kept opened.

Moreover, the contact ring 218 is abutted to the leading end peripheral part of an inside plug member 206 in this state, thereby preventing a liquid from leaking externally from the inside plug member 206 even in the case in which the coating container is made to be in a rollover state.

Even in the case in which a liquid held in the container body 202 is gasified and an internal pressure is increased, when the cap member 214 is detached and removed from the mouth part 204 of the container body 202, an airtight state caused by an abutment of the contact ring 218 and the leading end peripheral part of the inside plug member 206 is released, and the coating container can be degassed in a moment of time.

Moreover, in Patent document 2 (Japanese Patent Application Laid-Open Publication No. 2004-306999), a coating container 300 as shown in FIG. 19 is proposed.

More specifically, for the coating container 300 in accordance with Patent document 2, in the state in which a cap member 314 is fixed to a mouth part 304 of a container body 302, an abutting face 316 of the cap member 314 presses a valve element 312 downward while resisting against the urging force of an urging member 310. In addition, the abutting face 316 of the cap member 314 comes into contact with the leading end side of an inside plug member 306, thereby causing the discharge hole 308 of the inside plug member 306 to be kept closed.

By the above configuration, even in the case in which a liquid held in the container body 302 is gasified and an internal pressure is increased, when the cap member 314 is detached and removed from the mouth part 304 of the container body 302, an airtight state caused by an abutment of the abutting face 316 of the cap member 314 and the leading end side of the inside plug member 306 is released, and the coating container can be degassed in a moment of time.

Moreover, in Patent document 3 (Japanese Patent Application Laid-Open Publication No. 2003-160159), a coating container 400 as shown in FIG. 20 is proposed.

More specifically, for the coating container 400 in accordance with Patent document 3, in the state in which a cap member 414 is fixed to a mouth part 404 of a container body 402, a pressing cylinder 416 formed inside the top wall of the cap member 414 presses a valve element 412 downward while resisting against the urging force of an urging member 410, thereby causing a discharge hole 408 of an inside plug member 406 to be kept opened.

Moreover, the pressing cylinder 416 is fitted into the discharge hole 408 of the inside plug member 406 in this state, thereby preventing a liquid from leaking externally from the inside plug member 406 even in the case in which the coating container is made to be in a rollover state.

Even in the case in which a liquid held in the container body 402 is gasified and an internal pressure is increased, when the cap member 414 is detached and removed from the mouth part 404 of the container body 402, an airtight state caused by a fitting of the pressing cylinder 416 and the discharge hole 408 of the inside plug member 406 is released, and the coating container can be degassed in a moment of time via a groove portion 412*a* formed on the side of the valve element 412.

Patent document 1: Japanese Patent Application Laid-Open Publication No. 9-66959

Patent document 2: Japanese Patent Application Laid-Open Publication No. 2004-306999

Patent document 3: Japanese Patent Application Laid-Open Publication No. 2003-160159

DISCLOSURE OF THE INVENTION

Problems to be Solved by the Invention

However, each of such conventional coating containers has the following problems.

More specifically, for the coating container 200 in accordance with Patent document 1, in the state in which the cap member 214 is fixed to the mouth part 204 of the container body 202, the contact ring 218 is abutted to the leading end peripheral part of the inside plug member 206, thereby preventing a liquid from leaking externally from the inside plug member 206.

However, the discharge hole 208 of the inside plug member 206 is kept opened in this state. Consequently, an airtight state caused by an abutment of the contact ring 218 and the leading end peripheral part of the inside plug member 206 may be released by a vibration or a shock in the case in which the coating container is made to be in a rollover state, thereby causing a liquid held in the container body 202 to leak externally in some cases.

Moreover, depending on a frequency of use, the contact ring 218 may be worn and damaged, and an airtight state caused by an abutment of the contact ring 218 and the leading end peripheral part of the inside plug member 206 may be released, thereby causing a liquid held in the container body 202 to leak externally in some cases.

Furthermore, the pressing portion 216 must be formed inside the top wall of the cap member 214, and the contact ring 218 must be formed on the periphery of the pressing portion 216. Consequently, the structures of the coating container and a metal mold are complicated, thereby increasing a cost thereof.

For the coating container 300 in accordance with Patent document 2, in the state in which the cap member 314 is fixed to the mouth part 304 of the container body 302, the abutting face 316 of the cap member 314 comes into contact with the leading end side of an inside plug member 306, thereby causing the discharge hole 308 of the inside plug member 306 to be kept closed and thereby preventing a liquid from leaking externally from the inside plug member 306.

However, a space between the discharge hole 308 of the inside plug member 306 and the valve element 312 is kept opened in this state. Consequently, an airtight state caused by an abutment of the abutting face 316 of the cap member 314 and the leading end side of the inside plug member 306 may be released by a vibration or a shock in the case in which the coating container is made to be in a rollover state, thereby causing a liquid held in the container body 302 to leak externally in some cases.

For the coating container 400 in accordance with Patent document 3, the pressing cylinder 416 is fitted into the discharge hole 408 of the inside plug member 406, thereby preventing a liquid from leaking externally from the inside plug member 406.

However, a space between the discharge hole 408 of the inside plug member 406 and the valve element 412 is kept opened in this state. Consequently, an airtight state caused by a fitting of the pressing cylinder 416 of the cap member 414 and the discharge hole 408 of the inside plug member 406 may be released by a vibration or a shock in the case in which the coating container is made to be in a rollover state, thereby causing a liquid held in the container body 402 to leak externally in some cases.

The present invention was made in consideration of such conditions, and an object of the present invention is to provide a coating container of a push type. For the coating container, in the case in which a liquid having a high volatility such as ethanol series is held in the container body, even if a liquid held in the container body is gasified depending on an ambient temperature environment, when the cap member is detached and removed from the mouth part of the container body for a use, the coating container can be degassed. Moreover, in the case in which the leading end of the valve element projecting from the discharge hole of the inside plug member is pressed to a section to be coated to cause the discharge hole to be in the opened state, a liquid held in the container body is not discharged in quantity larger than the predetermined amount by an internal pressure of a gas in the container body, thereby enabling the coating to be carried out with precision. Furthermore, a discharged liquid is prevented from being dispersed over the surrounding area and from contaminating the section to be coated by an influence of a gas. Furthermore, the structure of the coating container can be simplified and a manufacturing cost of the coating container can be reduced.

Another object of the present invention is to provide a coating container. For the coating container, in the state in which the cap member is fixed to the mouth part of the container body and the coating container is not used, the valve element completely closes the discharge hole of the inside plug member, and a liquid held in the container body can be prevented from leaking externally even if a vibration or a shock occurs in the case in which the coating container is made to be in a rollover state.

Another object of the present invention is to provide a coating container. For the coating container, in the case in which the cap member is detached and removed for a use, the cap member is rotated in a detaching direction against the mouth part of the container body, thereby automatically degassing the coating container immediately before the use of the coating container. Moreover, by continuously rotating the cap member in the detaching direction, the cap member can be detached and removed from the mouth part of the container body by a simple operation.

Another object of the present invention is to provide a coating container. For the coating container, in the case in which the coating container is degassed immediately before the use of the coating container as described above, a liquid attached to the urging member that urges the valve element can be made fall in drops in the container body, and every last liquid in the container body can be used thoroughly.

Means for Solving the Problems

The present invention was made in order to solve the above problems of the conventional art and to achieve the purpose.

A coating container in accordance with the present invention is characterized by comprising:

an inside plug member fixed to a mouth part of a container body;

a valve element disposed at the inside plug member, the valve element capable of projecting from and withdrawing into a discharge hole formed at the leading end of the inside plug member and being urged in the direction of projecting from the discharge hole by an urging member in such a manner that the discharge hole is opened and closed; and a cap member detachably fixed to the mouth part of the container body, the cap member comprising:

an inner cap member detachably fixed to the mouth part of the container body;

an outer cap member fixed to the outside of the inner cap member; and a guiding means for guiding the outer cap member to be movable in the axial direction with respect to the inner cap member, wherein, in the state in which the cap member is fixed to the mouth part of the container body, the outer cap member is located in the direction of separating from the inner cap member in the axial direction, and the inner face of the top wall of the outer cap member is separated from the valve element to urge the valve element in the direction of projecting from the discharge hole of the inside plug member, thereby causing the discharge hole to be in the closed state, in the case in which the cap member is detached and removed from the mouth part of the container body, the outer cap member is moved in the direction of approaching the inner cap member in the axial direction, and the inner face of the top wall of the outer cap member is abutted to the valve element which is thereby urged in the direction of separating from the discharge hole of the inside plug member while resisting against the urging force of the urging member, thereby causing the discharge hole to be in the opened state, and in the state in which the cap member is detached from the mouth part of the container body, the valve element is urged in the direction of projecting from the discharge hole of the inside plug member by the urging force of the urging member, thereby causing the discharge hole to be in the closed state.

By the above configuration, in the case in which the cap member is detached and removed from the mouth part of the container body, the outer cap member is moved in the direction of approaching the inner cap member in the axial direction by the guiding means, and the inner face of the top wall of the outer cap member is abutted to the valve element which is thereby urged in the direction of separating from the discharge hole of the inside plug member while resisting against the urging force of the urging member, thereby causing the discharge hole to be in the opened state.

Consequently, in the case in which a liquid having a high volatility such as ethanol series is held in the container body, even if a liquid held in the container body is gasified depending on an ambient temperature environment, when the cap member is detached and removed from the mouth part of the container body for a use, the coating container can be degassed.

In the state in which the cap member is detached from the mouth part of the container body, the valve element is urged in the direction of projecting from the discharge hole of the inside plug member by the urging force of the urging member, thereby causing the discharge hole to be in the closed state.

In this state, in the case in which the leading end of the valve element projecting from the discharge hole of the inside plug member is pressed to the section to be coated to cause the discharge hole to be in the opened state, since the degassing is carried out in advance, a liquid held in the container body is not discharged in quantity larger than the predetermined amount by an internal pressure of a gas in the container body, thereby enabling the coating to be carried out with precision. Furthermore, a discharged liquid is prevented from being dispersed over the surrounding area and from contaminating the section to be coated by an influence of a gas.

Moreover, in the state in which the cap member is fixed to the mouth part of the container body and the coating container is not used, the outer cap member is located in the direction of separating from the inner cap member in the axial direction, and the inner face of the top wall of the outer cap member is separated from the valve element to urge the valve element in the direction of projecting from the discharge hole of the inside plug member, thereby causing the discharge hole to be in the completely closed state.

Consequently, in the state in which the cap member is fixed to the mouth part of the container body and the coating container is not used, the valve element completely closes the discharge hole of the inside plug member, and a liquid held in the container body can be prevented from leaking externally even if a vibration or a shock occurs in the case in which the coating container is made to be in a rollover state.

Moreover, in the state in which the cap member is detached from the mouth part of the container body, the valve element is urged in the direction of projecting from the discharge hole of the inside plug member by the urging force of the urging member, thereby causing the discharge hole to be in the closed state. Therefore, a liquid held in the container body can be prevented from leaking externally even if a vibration or a shock occurs in the case in which the coating container is made to be in a rollover state.

The coating container in accordance with the present invention is characterized in that:

the cap member is detachably fixed to the mouth part of the container body by rotating the cap member against the mouth part of the container body;

the outer cap member is guided to be moved in the direction of approaching the inner cap member in the axial direction by the guiding means by rotating the outer cap member in a detaching direction against the mouth part of the container body;

the outer cap member is locked to the inner cap member after the outer cap member is moved by a predetermined distance in the direction of approaching the inner cap member in the axial direction by the guiding means; and the outer cap member and the inner cap member can be detached from the mouth part of the container body in an integrated manner by further rotating the outer cap member in a detaching direction against the mouth part of the container body.

By the above configuration, the outer cap member is guided to be moved in the direction of approaching the inner cap member in the axial direction by the guiding means by rotating the outer cap member in a detaching direction against the mouth part of the container body.

Consequently, in the case in which the cap member is detached and removed for a use, the cap member is rotated in a detaching direction against the mouth part of the container body, thereby automatically degassing the coating container immediately before the use of the coating container.

Moreover, the outer cap member is locked to the inner cap member after the outer cap-member is moved by a predetermined distance in the direction of approaching the inner cap member in the axial direction by the guiding means, and the outer cap member and the inner cap member can be easily detached from the mouth part of the container body in an integrated manner and in an extremely convenient manner by further rotating the outer cap member in a detaching direction against the mouth part of the container body.

The coating container in accordance with the present invention is characterized in that the guiding means includes a guiding groove formed at the inner cap member and a guiding member that is formed at the outer cap member and that is guided in the guiding groove of the inner cap member.

By the above configuration, since the guiding member formed at the outer cap member is guided in the axial direction in the guiding groove of formed at the inner cap member, the above degassing operation can be carried out reliably.

The coating container in accordance with the present invention is characterized in that:

the guiding groove formed at the inner cap member is formed in a spiral shape on the outside wall of the side peripheral part of the inner cap member; and the guiding member formed at the outer cap member is formed in a protruding manner to the inside direction on the inside wall of the side peripheral part of the outer cap member.

By the above configuration, the guiding member formed in a protruding manner to the inside direction on the inside wall of the side peripheral part of the outer cap member is guided in the axial direction in the guiding groove formed in a spiral shape on the outside wall of the side peripheral part of the inner cap member. Consequently, since the outer cap member is guided to be moved in the direction of approaching the inner cap member in the axial direction by only rotating the outer cap member in a detaching direction against the mouth part of the container body, the above degassing operation can be carried out reliably and easily.

The coating container in accordance with the present invention is characterized in that the guiding means includes a guiding groove formed at the outer cap member and a guiding member that is formed at the inner cap member and that is guided in the guiding groove of the outer cap member.

By the above configuration, since the guiding member formed at the inner cap member is guided in the axial direction in the guiding groove of formed at the outer cap member, the above degassing operation can be carried out reliably.

The coating container in accordance with the present invention is characterized in that:

the guiding groove formed at the outer cap member is formed in a spiral shape on the inside wall of the side peripheral part of the outer cap member; and the guiding member formed at the inner cap member is formed in a protruding manner to the outside direction on the outside wall of the side peripheral part of the inner cap member.

By the above configuration, the guiding member formed in a protruding manner to the outside direction on the outside wall of the side peripheral part of the inner cap member is guided in the axial direction in the guiding groove formed in a spiral shape on the inside wall of the side peripheral part of the outer cap member. Consequently, since the outer cap member is guided to be moved in the direction of approaching the inner cap member in the axial direction by only rotating the outer cap member in a detaching direction against the mouth part of the container body, the above degassing operation can be carried out reliably and easily.

The coating container in accordance with the present invention is characterized in that an abutting portion is formed on the inner face of the top wall of the outer cap member for being abutted to the valve element.

By the above configuration, in the case in which the cap member is detached and removed from the mouth part of the container body, an abutting portion formed on the inner face of the top wall of the outer cap member is reliably abutted to the valve element, and the valve element is thereby urged in the direction of separating from the discharge hole of the inside plug member while resisting against the urging force of the urging member, thereby causing the discharge hole to be in the opened state and thereby reliably degassing the coating container immediately before the use of the coating container as described above.

The coating container in accordance with the present invention is characterized by further comprising a vibration imparting means for vibrating the outer cap member in the case in which the outer cap member is guided to be movable in the axial direction with respect to the inner cap member.

By the above configuration, the outer cap member can be vibrated by the vibration imparting means in the case in which the outer cap member is guided to be movable in the axial direction with respect to the inner cap member. Consequently, a vibration can be reliably transmitted to the urging member for urging the valve element via the outer cap member and the valve element in the case in which the coating container is degassed immediately before the use of the coating container. Therefore, a liquid attached to the urging member can be made fall in drops in the container body, and every last liquid in the container body can be used thoroughly.

The coating container in accordance with the present invention is characterized in that the vibration imparting means is formed at the contact section of the outer cap member and the inner cap member.

By the above configuration, since the vibration imparting means is formed at the contact section of the outer cap member and the inner cap member, the outer cap member can be vibrated reliably in the case in which the outer cap member is guided to be movable in the axial direction with respect to the inner cap member. Consequently, a vibration can be reliably transmitted to the urging member for urging the valve element in the case in which the coating container is degassed immediately before the use of the coating container. Therefore, a liquid attached to the urging member can be made fall in drops in the container body, and every last liquid in the container body can be used thoroughly.

The coating container in accordance with the present invention is characterized in that the vibration imparting means includes a concave and convex portion formed at the guiding groove and a protruding portion formed on the guiding member for being guided on the concave and convex portion in a sliding manner.

By the above configuration, since the protruding portion formed on the guiding member is guided in a sliding manner on the concave and convex portion formed at the guiding groove, the outer cap member can be vibrated reliably. Consequently, a vibration can be reliably transmitted to the urging member for urging the valve element in the case in which the coating container is degassed immediately before the use of the coating container. Therefore, a liquid attached to the urging member can be made fall in drops in the container body, and every last liquid in the container body can be used thoroughly.

The coating container in accordance with the present invention is characterized in that the valve element and the urging member are formed in an integrated manner.

By the above configuration, since the valve element and the urging member are formed in an integrated manner, the valve element can smoothly project from and withdraw into the discharge hole formed at the leading end of the inside plug member in such a manner that the discharge hole is opened and closed, thereby reliably degassing the coating container immediately before the use of the coating container.

Moreover, in the case in which the outer cap member is vibrated, a vibration can be reliably transmitted to the urging member for urging the valve element via the outer cap member and the valve element in the case in which the coating container is degassed immediately before the use of the coating container. Therefore, a liquid attached to the urging member can be made fall in drops in the container body, and every last liquid in the container body can be used thoroughly.

The coating container in accordance with the present invention is characterized in that at least one groove for discharge is formed on the leading end portion of the valve element.

By the above configuration, in the case in which the outer cap member is moved in the direction of approaching the inner cap member in the axial direction by the guiding means, and the valve element is thereby urged in the direction of separating from the discharge hole of the inside plug member while resisting against the urging force of the urging member, thereby causing the discharge hole to be in the opened state, degassing can be carried out reliably through the groove for discharge.

Moreover, in the case in which the leading end of the valve element projecting from the discharge hole of the inside plug member is pressed to the section to be coated and the discharge hole is opened to carry out a coating operation, a certain amount of a liquid can be coated to the section to be coated with precision through the groove for discharge.

Effect of the Invention

By the present invention, in the case in which the cap member is detached and removed from the mouth part of the container body, the outer cap member is moved in the direction of approaching the inner cap member in the axial direction by the guiding means, and the inner face of the top wall of the outer cap member is abutted to the valve element which is thereby urged in the direction of separating from the discharge hole of the inside plug member while resisting against the urging force of the urging member, thereby causing the discharge hole to be in the opened state.

Consequently, in the case in which a liquid having a high volatility such as ethanol series is held in the container body, even if a liquid held in the container body is gasified depending on an ambient temperature environment, when the cap member is detached and removed from the mouth part of the container body for a use, the coating container can be degassed.

In the state in which the cap member is detached from the mouth part of the container body, the valve element is urged in the direction of projecting from the discharge hole of the inside plug member by the urging force of the urging member, thereby causing the discharge hole to be in the closed state.

In this state, in the case in which the leading end of the valve element projecting from the discharge hole of the inside plug member is pressed to the section to be coated to cause the discharge hole to be in the opened state, since the degassing is carried out in advance, a liquid held in the container body is not discharged in quantity larger than the predetermined amount by an internal pressure of a gas in the container body, thereby enabling the coating to be carried out with precision. Furthermore, a discharged liquid is prevented from being dispersed over the surrounding area and from contaminating the section to be coated by an influence of a gas.

Moreover, in the state in which the cap member is fixed to the mouth part of the container body and the coating container is not used, the outer cap member is located in the direction of separating from the inner cap member in the axial direction, and the inner face of the top wall of the outer cap member is separated from the valve element to urge the valve element in the direction of projecting from the discharge hole of the inside plug member, thereby causing the discharge hole to be in the completely closed state.

Consequently, in the state in which the cap member is fixed to the mouth part of the container body and the coating container is not used, the valve element completely closes the discharge hole of the inside plug member, and a liquid held in the container body can be prevented from leaking externally even if a vibration or a shock occurs in the case in which the coating container is made to be in a rollover state.

Moreover, in the state in which the cap member is detached from the mouth part of the container body, the valve element is urged in the direction of projecting from the discharge hole of the inside plug member by the urging force of the urging member, thereby causing the discharge hole to be in the closed state. Therefore, a liquid held in the container body can be prevented from leaking externally even if a vibration or a shock occurs in the case in which the coating container is made to be in a rollover state.

Moreover, by the present invention, the outer cap member is guided to be moved in the direction of approaching the inner cap member in the axial direction by the guiding means by rotating the outer cap member in a detaching direction against the mouth part of the container body.

Consequently, in the case in which the cap member is detached and removed for a use, the cap member is rotated in a detaching direction against the mouth part of the container body, thereby automatically degassing the coating container immediately before the use of the coating container.

Moreover, the outer cap member is locked to the inner cap member after the outer cap member is moved by a predetermined distance in the direction of approaching the inner cap member in the axial direction by the guiding means, and the outer cap member and the inner cap member can be easily detached from the mouth part of the container body in an integrated manner and in an extremely convenient manner by further rotating the outer cap member in a detaching direction against the mouth part of the container body.

Furthermore, by the present invention, the outer cap member can be vibrated by the vibration imparting means in the case in which the outer cap member is guided to be movable in the axial direction with respect to the inner cap member. Consequently, a vibration can be reliably transmitted to the urging member for urging the valve element via the outer cap member and the valve element in the case in which the coating container is degassed immediately before the use of the coating container. Therefore, a liquid attached to the urging member can be made fall in drops in the container body, and every last liquid in the container body can be used thoroughly.

EXPLANATIONS OF LETTERS OR NUMERALS

Figure 1:
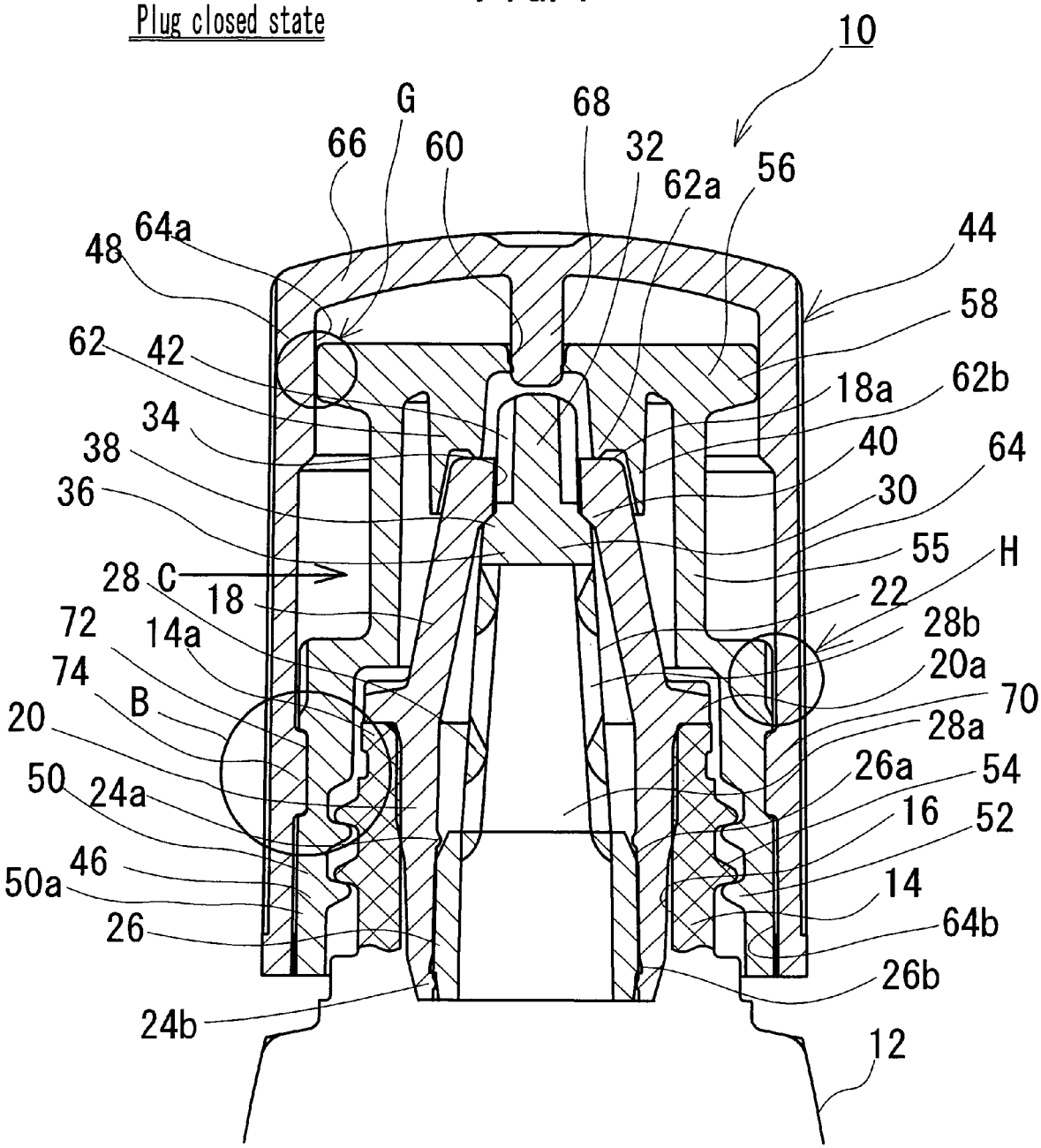
FIG. 1 is a partially enlarged vertical cross-sectional view showing a plug closed state of a coating container in accordance with the present invention.

10: Coating container
12: Container body
14: Mouth part
14*a*: Upper end
16: Inner wall
18: Inside plug member
18*a*: Leading end
20: Base end portion
20*a*: Flange portion
22: Valve member
24*a*: Locking rib
26: Base end portion
26*a*: Step portion
28: Spring portion
28*a*: Internal space
28*b*: Opening portion
30: Valve element
32: Leading end portion
34: Discharge hole
36: Base end portion
38: Step portion
40: Step portion
42: Groove for discharge
44: Cap member
46: Inner cap member
48: Outer cap member
50: Lower side peripheral wall
50*a*: Outside wall
52: Screw portion
54: Screw portion
55: Upper side peripheral wall
56: Top wall
58: Flange portion
58*a*: Free rotation preventing guiding groove
58*b* and 58*c*: End portions
60: Opening portion
62: Ring member
62*a*: Abutting rib portion
62*b*: Peripheral rib portion
64: Side peripheral wall
64*a*: Inside wall
64*b*: Inside wall
64*c*: Free rotation preventing rib
66: Top wall
68: Abutting portion
70: Guiding means
71: Upper guiding groove
72: Guiding groove
72*a*: End portion
72*b*: End portion
72*d*: Locking portion
73: Guiding slant face
74: Guiding member
76: Vibration imparting means
78*a*: Concave and convex portion
80*a*: Protruding portion
100: Coating container
102: Container body
104: Mouth part
106: Inside plug member
108: Discharge hole
110: Urging member
112: Valve element
114: Cap member
200: Coating container
202: Container body
204: Mouth part
206: Inside plug member
208: Discharge hole
210: Urging member
212: Valve element
214: Cap member

216: Pressing portion
218: Contact ring
300: Coating container
302: Container body
304: Mouth part
306: Inside plug member
308: Discharge hole
310: Urging member
312: Valve element
314: Cap member
316: Abutting face
400: Coating container
402: Container body
404: Mouth part
406: Inside plug member
408: Discharge hole
410: Urging member
412: Valve element
412*a*: Groove portion
414: Cap member
416: Pressing cylinder
A: Section to be coated

BEST MODE OF CARRYING OUT THE INVENTION

An embodiment (example) of the present invention will be described below in detail with reference to the drawings.

Figure 2:
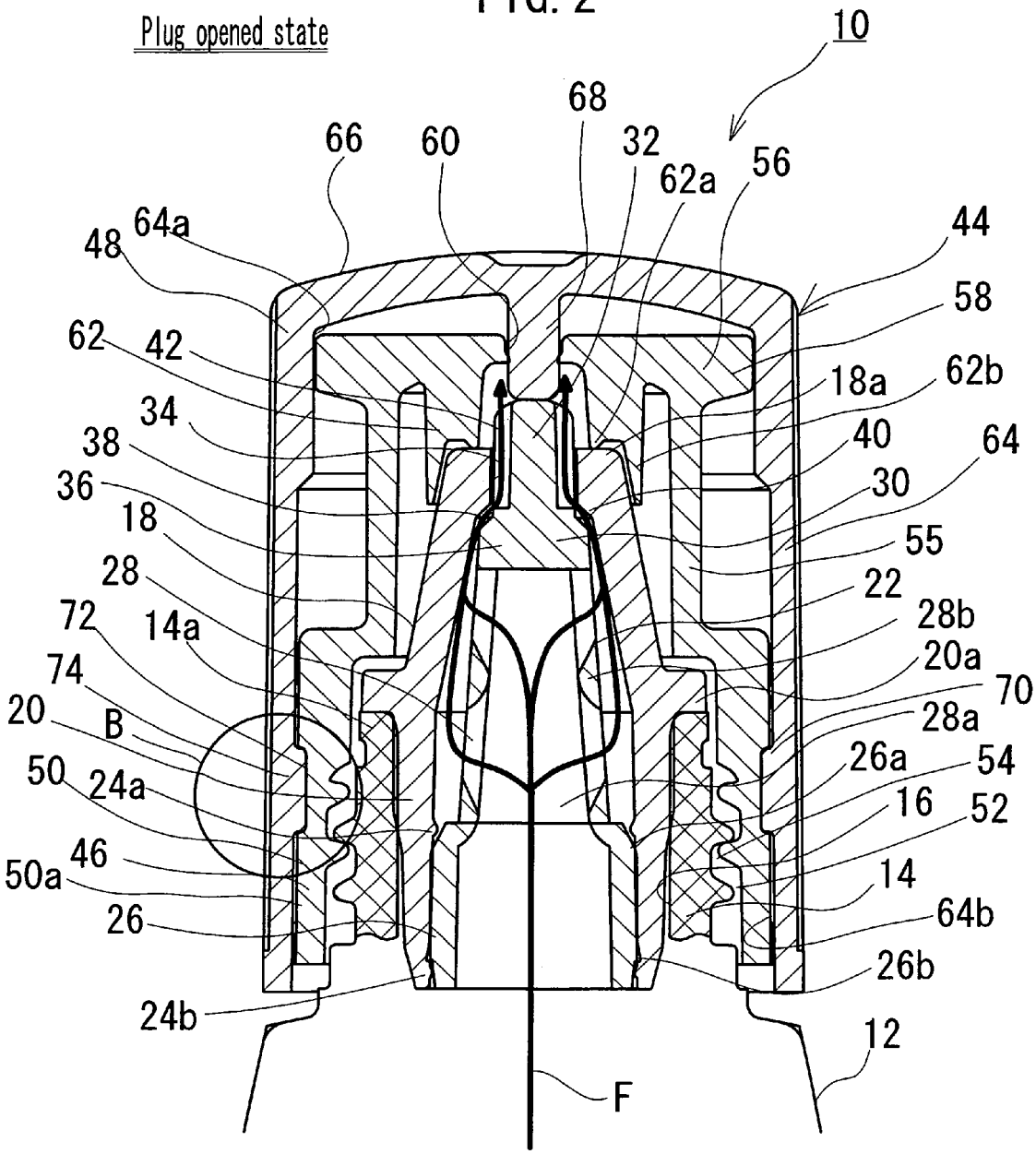
FIG. 2 is a partially enlarged vertical cross-sectional view showing a plug opened state of a coating container in accordance with the present invention.
Figure 3:
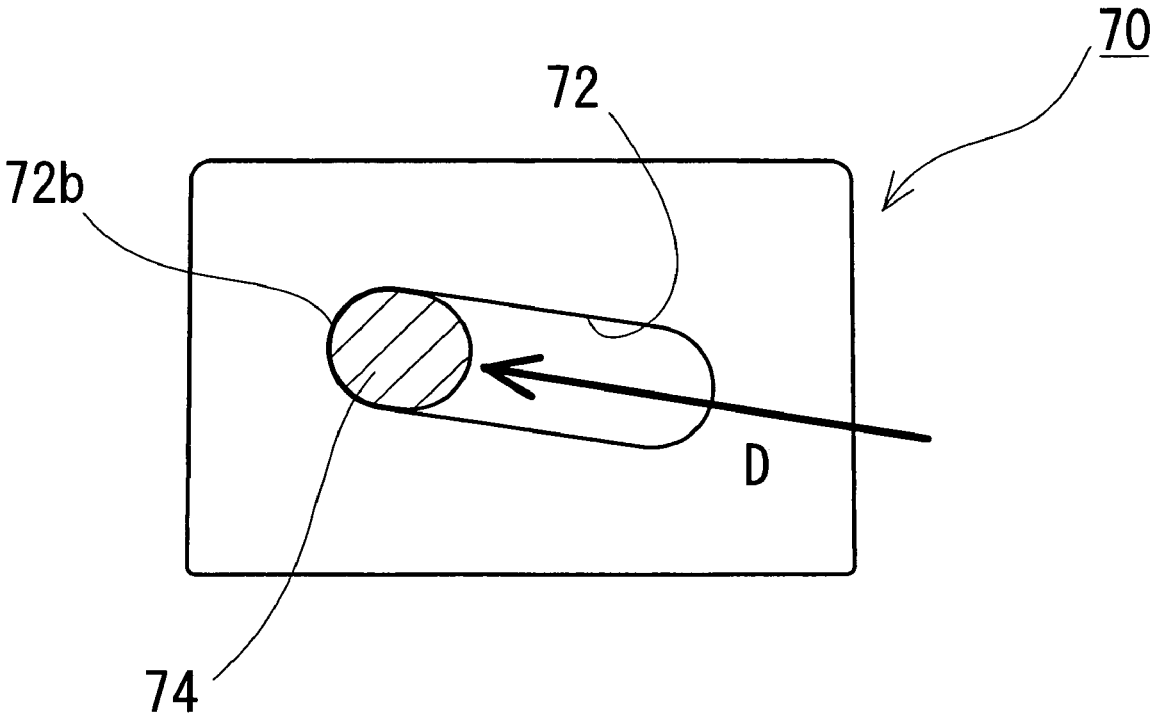
FIG. 3 is a schematic view showing a section B of FIG. 1 for illustrating a means of guiding an outer cap member to be movable in the axial direction with respect to an inner cap member for the coating container in accordance with the present invention.
Figure 4:
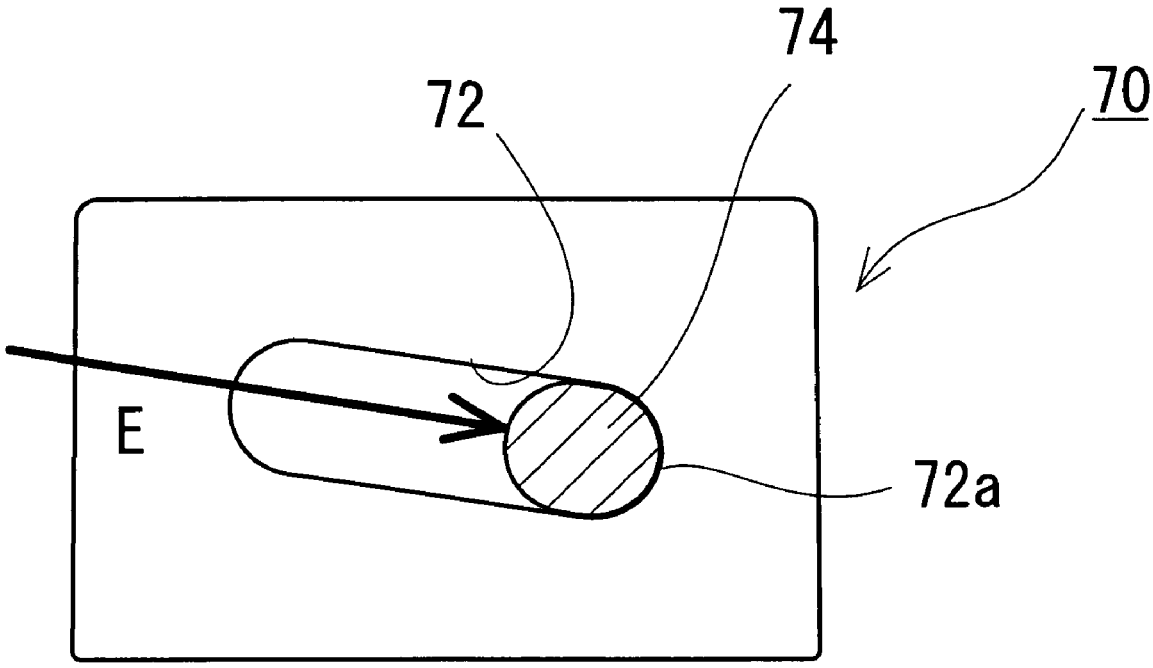
FIG. 4 is a schematic view showing a section B of FIG. 2 for illustrating a means of guiding an outer cap member to be movable in the axial direction with respect to an inner cap member for the coating container in accordance with the present invention.
Figure 5:
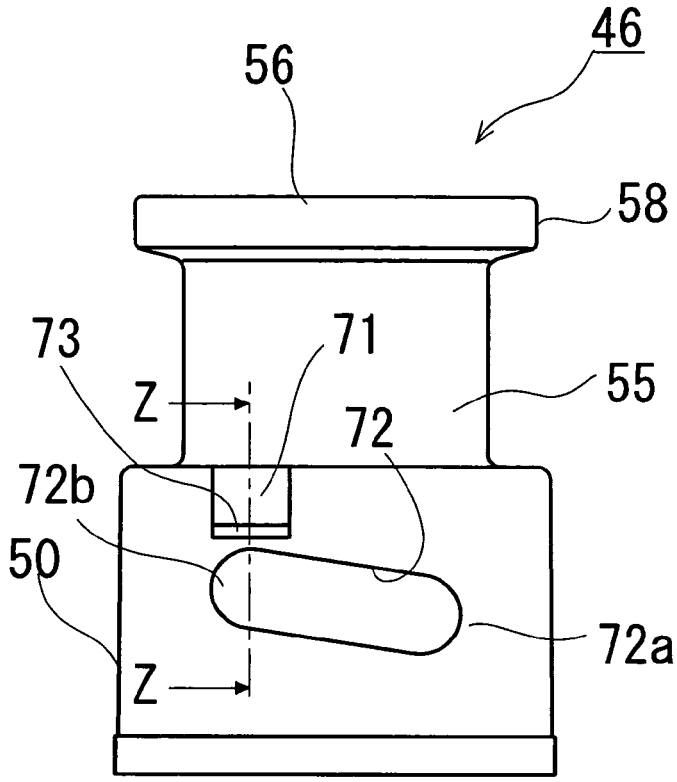
FIG. 5(A) is a view in a direction of the arrow C for the inner cap member of FIG. 1.
FIG. 5(B) is a cross-sectional view taken along the line Z-Z of FIG. 5(A).
Figure 5:
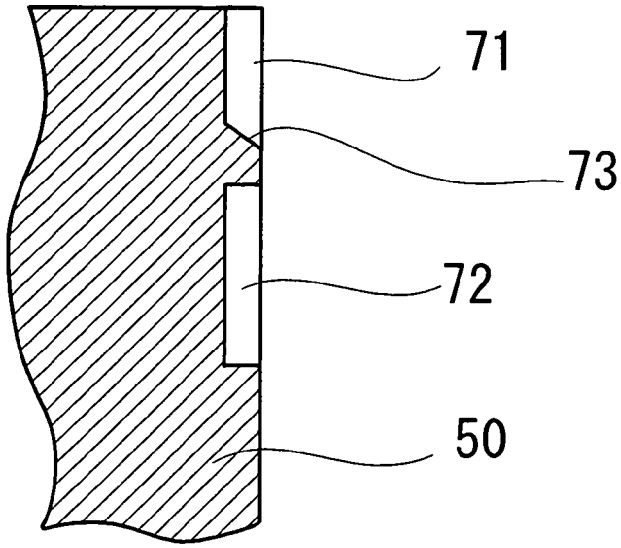

FIG. 1 is a partially enlarged vertical cross-sectional view showing a plug closed state of a coating container in accordance with the present invention. FIG. 2 is a partially enlarged vertical cross-sectional view showing a plug opened state of a coating container in accordance with the present invention. FIG. 3 is a schematic view showing a section B of FIG. 1 for illustrating a means of guiding an outer cap member to be movable in the axial direction with respect to an inner cap member for the coating container in accordance with the present invention. FIG. 4 is a schematic view showing a section B of FIG. 2 for illustrating a means of guiding an outer cap member to be movable in the axial direction with respect to an inner cap member for the coating container in accordance with the present invention. FIG. 5(A) is a view in a direction of the arrow C for the inner cap member of FIG. 1, and FIG. 5(B) is a cross-sectional view taken along the line Z-Z of FIG. 5(A).

In FIGS. 1 and 2, a numeral 10 represents a coating container in accordance with the present invention as a whole.

As shown in FIGS. 1 and 2, a coating container 10 in accordance with the present invention is a coating container of a push type, and is provided with a container body 12 in a bottle shape for holding a liquid such as a liquid for a medical agent, a cosmetic liquid, and an industrial liquid. A base end portion 20 of an inside plug member 18 in an almost nozzle shape is fixed to be fitted into an inner wall 16 of a mouth part 14 of the container body 12.

A flange portion 20*a* protruding to the peripheral side is formed above the base end portion 20 of the inside plug member 18 and on the almost middle section of the side wall of the inside plug member 18. The flange portion 20*a* is abutted to an upper end 14*a* of the mouth part 14 of the container body 12, thereby holding up the inside plug member 18 in such a manner that the inside plug member 18 does not fall into the container body 12.

A valve member 22 is held in the base end portion 20 of the inside plug member 18. More specifically, locking ribs 24*a* and 24*b* for locking the inside plug member are formed on the inside wall of the base end portion 20 of the inside plug member 18, and a base end portion 26 in an almost cylindrical shape of the valve member 22 is fitted between the locking ribs 24*a* and 24*b*.

Step portions 26*a* and 26*b* formed on the outside wall of the base end portion 26 of the valve member 22 are locked by the locking ribs 24*a* and 24*b* for locking the inside plug member in the base end portion 20 of the inside plug member 18, thereby fixing the base end portion 26 of the valve member 22 in the base end portion 20 of the inside plug member 18.

A spring portion 28 in a coil spring shape that configures an urging member is formed in an extending manner above the base end portion 26 of the valve member 22, and a valve element 30 in a tower head shape is formed at the upper end of the spring portion 28.

A leading end portion 32 of the valve element 30 can project from and withdraw into a discharge hole 34 formed at the leading end 18*a* of the inside plug member 18 in such a manner that the discharge hole 34 is opened and closed. The leading end portion 32 is urged in the direction of projecting from the discharge hole 34 by the spring portion 28 that is an urging member.

More specifically, as shown in FIG. 1, the leading end portion 32 of the valve element 30 is urged in the direction of projecting from the discharge hole 34 by the spring portion 28 in a plug closed state. In this state, a step portion 38 of a base end portion 36 of the valve element 30 is abutted to a step portion 40 that is formed on the inside wall of the leading end 18*a* of the inside plug member 18 and that configures a seat of a valve, thereby closing the discharge hole 34 (plug closed).

A plurality of grooves 42 extending in the axial direction for discharge is formed on the leading end portion 32 of the valve element 30. As shown in FIG. 2, degassing can be carried out reliably through the grooves 42 for discharge in a plug opened state as described later.

The number and dimension of the grooves 42 for discharge are not restricted in particular, and can be selected properly depending on a specified amount of coating and a type of a liquid. For instance, two, three, or four grooves can also be formed in a circumferential direction of the leading end portion 32 of the valve element 30.

Moreover, since the spring portion 28 is in a coil spring shape, a plurality of opening portions 28*b* being communicated with an internal space 28*a* of the spring portion 28 is formed as shown in FIGS. 1 and 2.

Figure 8:
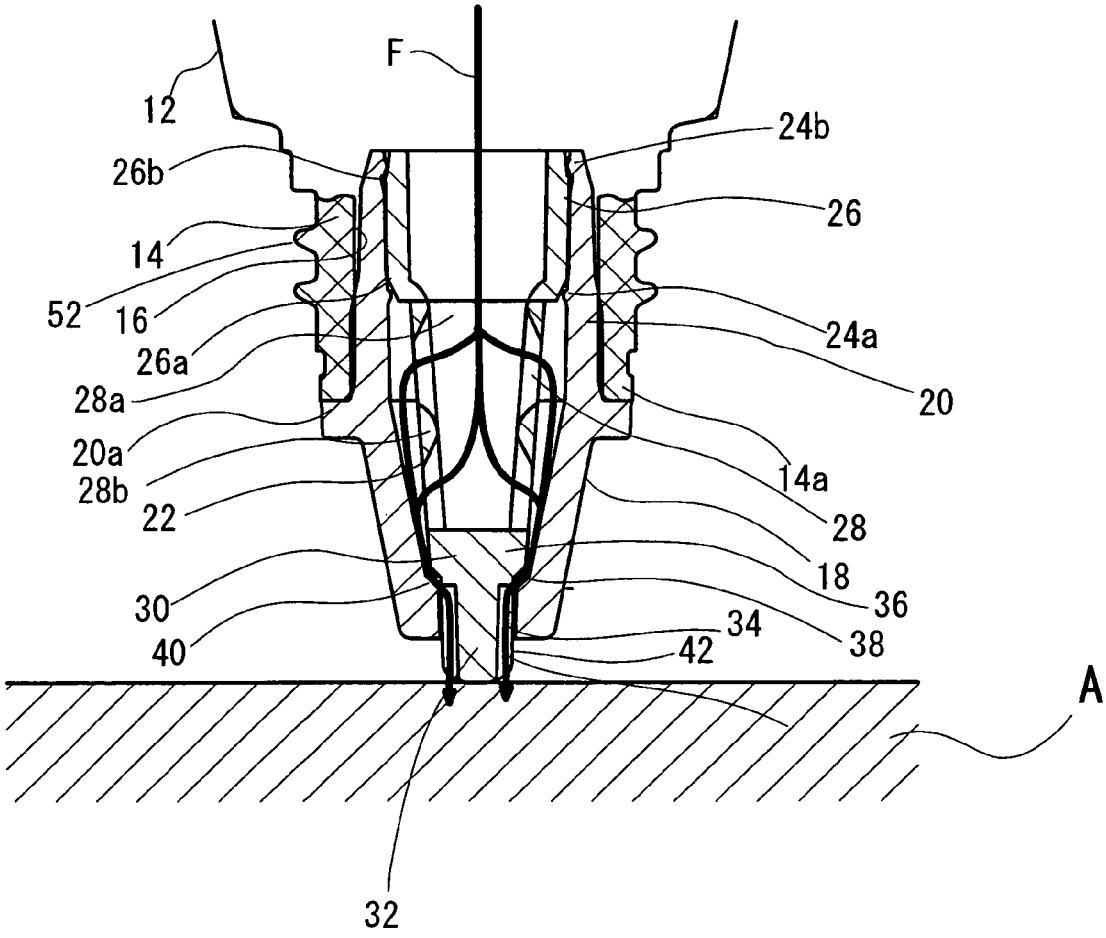
FIG. 8 is a partially enlarged vertical cross-sectional view for illustrating a usage state of a coating container in accordance with the present invention.

As described later and as shown in FIG. 8, in the case in which the leading end of the valve element 30 projecting from the discharge hole 34 of the inside plug member 18 is pressed to a section to be coated and the discharge hole 34 is opened to carry out a coating operation, a certain amount of a liquid held in the container body 12 can be coated with precision through the grooves 42 for discharge.

Moreover, a cap member 44 is detachably fixed to the mouth part 14 of the container body 12. The cap member 44 is provided with an inner cap member 46 detachably fixed to the mouth part 14 of the container body 12 and an outer cap member 48 fixed to the outside of the inner cap member 46.

The inner cap member 46 is provided with a lower side peripheral wall 50 in an almost cylindrical shape, and a screw portion 52 is formed on the inner periphery of the lower side peripheral wall 50. By screwing a screw portion 54 formed on the outer periphery of the mouth part 14 of the container body 12 into the screw portion 52 of the inner cap member 46, the inner cap member 46, that is, the cap member 44 composed of the inner cap member 46 and the outer cap member 48 can be detachably fixed to the mouth part 14 of the container body 12.

An upper side peripheral wall 55 having a diameter smaller than that of the lower side peripheral wall 50 is formed above the lower side peripheral wall 50 of the inner cap member 46, and a top wall 56 is formed on the upper end of the upper side peripheral wall 55.

A flange portion 58 protruding to the peripheral side is formed on the top wall 56, and an opening portion 60 is formed at the middle section of the top wall 56. A ring member 62 is formed in a hanging manner on the inner face of the top wall 56 and on the periphery of the opening portion 60.

The ring member 62 is provided with an abutting rib portion 62*a* and a peripheral rib portion 62*b*. The abutting rib portion 62*a* on the inner peripheral side is abutted to a leading end 18*a* of the inside plug member 18 in the state in which the inner cap member 46 is fixed to the mouth part 14 of the container body 12. The peripheral rib portion 62*b* is formed on the outer peripheral side of the abutting rib portion 62*a* and has a shape along the side peripheral wall around the leading end 18*a* of the inside plug member 18.

On the other hand, the outer cap member 48 is in an almost cylindrical shape with a closed end, and is provided with a side peripheral wall 64 in an almost cylindrical shape and a top wall 66 formed on the upper end of the side peripheral wall 64. An abutting portion 68 in an almost cylindrical shape that is abutted to the leading end portion 32 of the valve element 30 during degassing as described later is formed on the inner face of the top wall 66 in a downward protruding manner.

More specifically, as shown in FIGS. 1 and 2, the abutting portion 68 of the outer cap member 48 is fixed in an inserting manner into the discharge hole 34 of the inside plug member 18. The flange portion 58 formed on the top wall 56 of the inner cap member 46 comes into contact with an inside wall 64*a* formed above the side peripheral wall 64 of the outer cap member 48, thereby supporting the outer cap member 48.

Moreover, an outside wall 50*a* of the lower side peripheral wall 50 of the inner cap member 46 comes into contact with an inside wall 64*b* of a base end portion of the side peripheral wall 64 at the lower side of the outer cap member 48, thereby supporting the outer cap member 48.

This supporting site is provided with a guiding means 70 for guiding the outer cap member 48 to be movable in the axial direction with respect to the inner cap member 46.

As shown in FIGS. 1 to 5, the guiding means 70 is provided with a guiding groove 72 formed in a spiral shape downward in the axial direction and on the outside wall 50*a* of the lower side peripheral wall 50 of the inner cap member 46. In addition, the guiding means 70 is provided with a guiding member 74 in an almost elliptical cylindrical shape formed in a protruding manner to the inside direction on the inside wall 64*b* of a base end portion of the side peripheral wall 64 of the outer cap member 48. The guiding member 74 is guided in the guiding groove 72 of the inner cap member 46.

Although the guiding member 74 is in an almost elliptical cylindrical shape in the present embodiment, the shape of the guiding member is not restricted in particular. For instance, the guiding member can also be in a cylindrical shape.

In this case, in the case in which the outer cap member 48 is fixed to the outside of the inner cap member 46, the guiding member 74 of the outer cap member 48 can be fitted into the guiding groove 72 of the inner cap member 46 by so-called a snap fit system. In the snap fit system, a diameter of the lower end side of the side peripheral wall 64 of the outer cap member 48 can be enlarged by fabricating the outer cap member 48 with a member having flexibility such as a synthetic resin.

Although the guiding groove 72 is in a groove shape in the present embodiment, a guiding opening can also be formed as a matter of course.

As shown in FIG. 5(B), an upper guiding groove 71 and a guiding slant face 73 can also be formed above the guiding groove 72 to enable the guiding member 74 to be easily inserted into the guiding groove 72 in the case in which the outer cap member 48 is fixed to the inner cap member 46.

Figure 6:
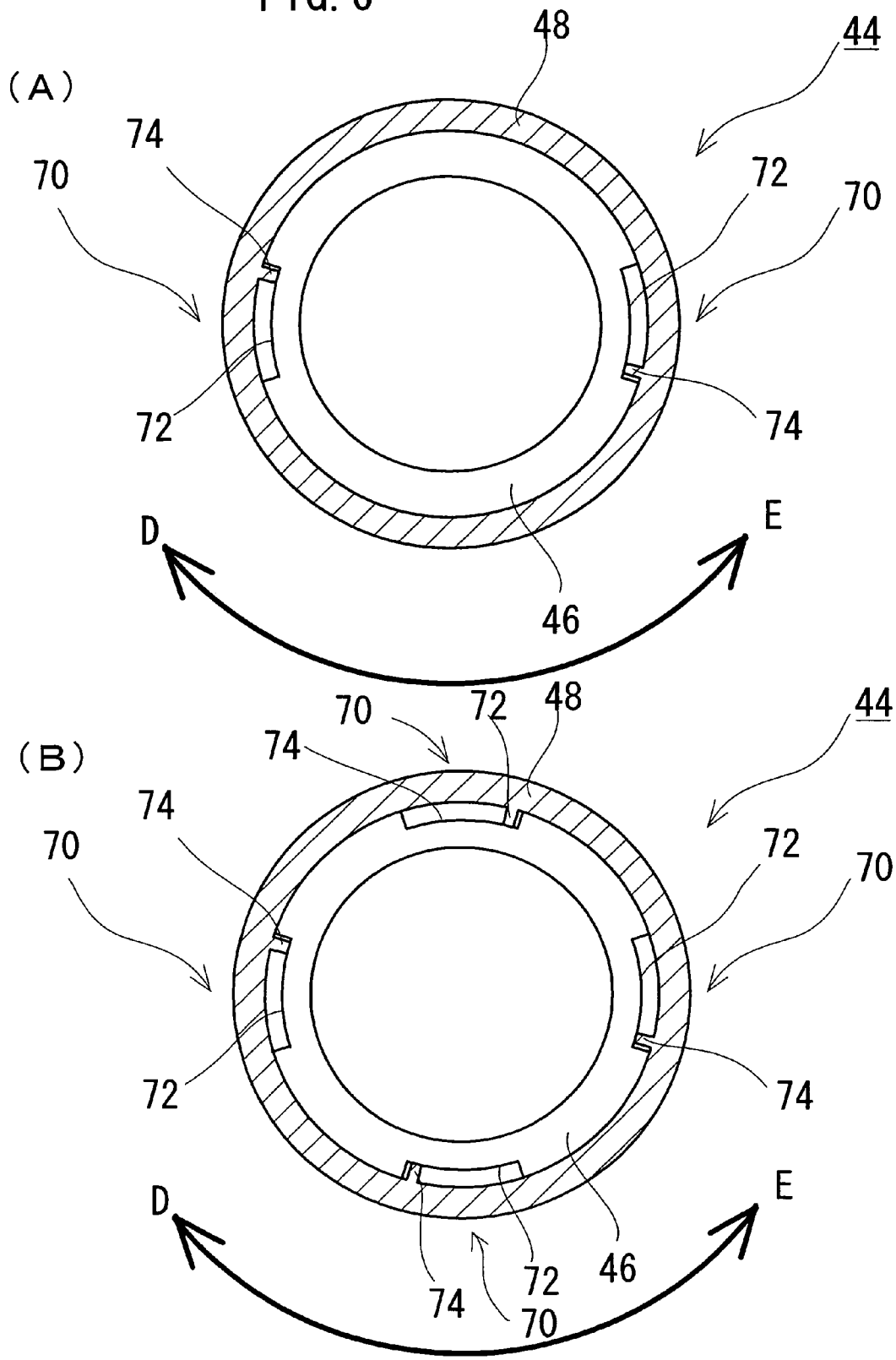
FIG. 6 is a schematic plan view for illustrating a means of guiding an outer cap member to be movable in the axial direction with respect to an inner cap member.

Although the guiding means 70 is formed at the two points on the diagonal line as shown in FIG. 6(A) in the embodiment shown in FIGS. 1 to 5, the number of the guiding means is not restricted. For instance, four guiding means can also be formed apart at intervals of a central angle of 90 degrees as shown in FIG. 6(B).

A method for using a coating container having the above configuration in accordance with the present invention will be described in the following.

As shown in FIG. 1, by rotating the outer cap member 48 in a fastening direction (that is, in a direction of an arrow D), the screw portion 52 of the inner cap member 46 is screwed in the direction of fastening to a screw portion 54 formed on the outer periphery of the mouth part 14 of the container body 12. As a result, the cap member 44 composed of the inner cap member 46 and the outer cap member 48 can be fixed to the mouth part 14 of the container body 12.

In this state, as shown in FIG. 3, the guiding member 74 of the outer cap member 48 is moved in the direction of fastening the outer cap member 48, that is, in a direction of an arrow D shown in FIG. 3. Consequently, the guiding member 74 is guided and moved to the upper end position of the guiding groove 72 of the inner cap member 46.

In this state, the outer cap member 48 is located in the direction of separating from the inner cap member 46 in the axial direction. That is, as shown in FIG. 1, the outer cap member 48 is located in the upper direction of the inner cap member 46.

In this state, as shown in FIG. 1, the abutting portion 68 of the outer cap member 48 is moved upwards close to the inlet of the discharge hole 34 of the inside plug member 18, and the abutting portion 68 is located at a position separated from the leading end portion 32 of the valve element 30.

Consequently, in this state, the leading end portion 32 is urged in the direction of projecting from the discharge hole 34 by the spring portion 28 that is an urging member.

More specifically, as shown in FIG. 1, the leading end portion 32 of the valve element 30 is urged in the direction of projecting from the discharge hole 34 by the spring portion 28 in a plug closed state. In this state, a step portion 38 of a base end portion 36 of the valve element 30 is abutted to a step portion 40 that is formed on the inside wall of the leading end 18*a* of the inside plug member 18 and that configures a seat of a valve, thereby closing the discharge hole 34 (plug closed).

Consequently, in the state in which the cap member 44 is fixed to the mouth part 14 of the container body 12 and the coating container 10 is not used, the valve element 30 completely closes the discharge hole 34 of the inside plug member 18, and a liquid held in the container body 12 can be prevented from leaking externally even if a vibration or a shock occurs in the case in which the coating container 10 is made to be in a rollover state.

In this state, the abutting rib portion 62*a* of the ring member 62 formed on the inner face of the top wall 56 is abutted to the leading end 18*a* of the inside plug member 18. Consequently, a liquid held in the container body can be prevented from leaking externally even in the case in which the coating container 10 is made to be in a rollover state.

In order to carry out degassing during coating from this state, by rotating the outer cap member 48 in a detaching direction (that is, in a direction of an arrow E shown in FIG. 6), the screw portion 52 of the inner cap member 46 is rotated in the direction of releasing the screwing from the screw portion 54 formed on the outer periphery of the mouth part 14 of the container body 12.

As shown in FIG. 4, the guiding member 74 of the outer cap member 48 is moved in the direction of detaching the outer cap member 48, that is, in a direction of an arrow E shown in FIG. 4. Consequently, the guiding member 74 is guided and moved to the lower end position of the guiding groove 72 of the inner cap member 46.

In this state, the outer cap member 48 is located in the direction of approaching the inner cap member 46 in the axial direction. That is, as shown in FIG. 2, the outer cap member 48 is located in the lower direction of the inner cap member 46.

As shown in FIG. 2, the abutting portion 68 of the outer cap member 48 is moved downwards to the discharge hole 34 of the inside plug member 18, and the abutting portion 68 is abutted to the leading end portion 32 of the valve element 30. The valve element 30 is then urged in the direction of separating from the discharge hole 34 of the inside plug member 18 while resisting against the urging force of the spring portion 28 that is an urging member to cause the discharge hole 34 to be in the opened state.

By such a configuration, in the case in which a liquid having a high volatility such as ethanol series is held in the container body 12, even if a liquid held in the container body 12 is gasified depending on an ambient temperature environment, degassing can be reliably carried out in a moment of time from the inside of the container body 12 through the internal space 28*a* of the spring portion 28, a plurality of opening portions 28*b* being communicated with the internal space 28*a*, and the grooves 42 formed for discharge on the leading end portion 32 of the valve element 30 as shown by an arrow F in FIG. 2.

Subsequently, by further rotating the outer cap member 48 in a detaching direction (that is, in a direction of an arrow E shown in FIG. 6), the guiding member 74 of the outer cap member 48 is locked to an end portion 72*a* of the guiding groove 72 in the state as shown in FIG. 4.

More specifically, in the state in which the outer cap member 48 is locked to the inner cap member 46, in the case in which the outer cap member 48 is further rotated in a detaching direction, the screwing of the screw portion 52 of the inner cap member 46 and the screw portion 54 formed on the outer periphery of the mouth part 14 of the container body 12 is released, and the outer cap member 48 and the inner cap member 46 can be detached from the mouth part 14 of the container body 12 in an integrated manner.

Figure 7:
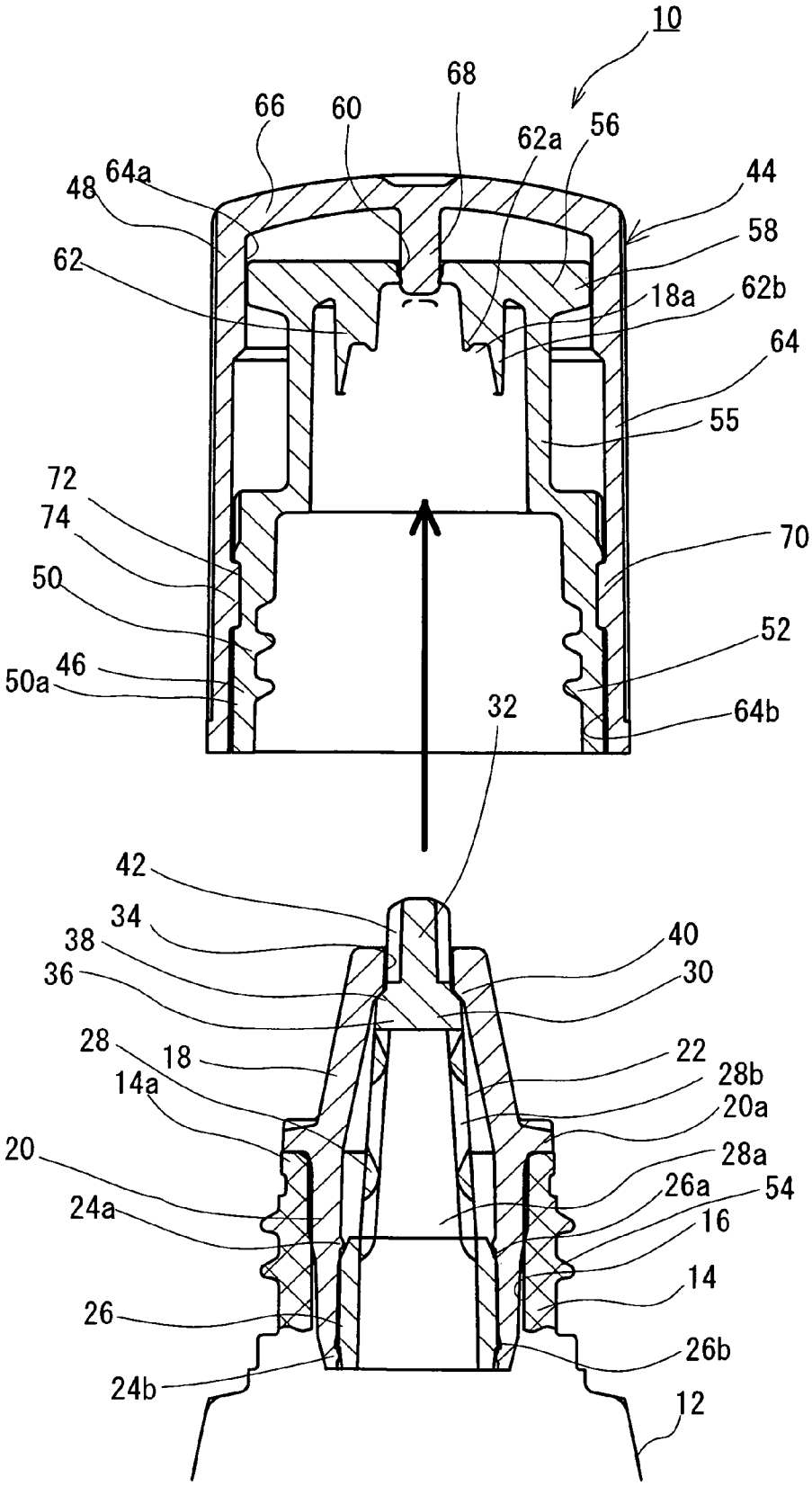
FIG. 7 is a partially enlarged vertical cross-sectional view for illustrating a usage state of a coating container in accordance with the present invention.

With the steps, as shown in FIG. 7, an abutment of the abutting portion 68 of the outer cap member 48 to the leading end portion 32 of the valve element 30 is released. Consequently, the leading end portion 32 is urged again in the direction of projecting from the discharge hole 34 by the spring portion 28 that is an urging member.

More specifically, as shown in FIG. 7, the leading end portion 32 of the valve element 30 is urged in the direction of projecting from the discharge hole 34 by the spring portion 28 in a plug closed state. In this state, a step portion 38 of a base end portion 36 of the valve element 30 is abutted to a step portion 40 that is formed on the inside wall of the leading end 18*a* of the inside plug member 18 and that configures a seat of a valve, thereby closing the discharge hole 34 (plug closed).

Consequently, in the state in which the cap member 44 is detached from the mouth part 14 of the container body 12, the valve element 30 is urged in the direction of projecting from the discharge hole 34 of the inside plug member 18 by the spring portion 28 that is an urging member, thereby causing the discharge hole 34 to be in the closed-state. Therefore, a liquid held in the container body 12 can be prevented from leaking externally even if a vibration or a shock occurs in the case in which the coating container is made to be in a rollover state.

In order to coat a section A to be coated with a liquid held in the container body 12, as shown in FIG. 8, the leading end of the valve element 30 projecting from the discharge hole 34 of the inside plug member 18 is pressed to the section to be coated.

By such a configuration, the valve element 30 is urged in the direction of separating from the discharge hole 34 of the inside plug member 18 while resisting against the urging force of the spring portion 28 that is an urging member to cause the discharge hole 34 to be in the opened state.

Consequently, the section A to be coated can be coated with a certain amount of a liquid held in the container body 12 with precision from the inside of the container body 12 through the internal space 28*a* of the spring portion 28, a plurality of opening portions 28*b* being communicated with the internal space 28*a*, and the grooves 42 formed for discharge on the leading end portion 32 of the valve element 30.

In this state, in the case in which the leading end of the valve element 30 projecting from the discharge hole 34 of the inside plug member 18 is pressed to the section A to be coated to cause the discharge hole 34 to be in the opened state, since the degassing is carried out in advance as described above, a liquid held in the container body 12 is not discharged in quantity larger than the predetermined amount by an internal pressure of a gas in the container body 12, thereby enabling the coating to be carried out with precision. Furthermore, a discharged liquid is prevented from being dispersed over the surrounding area and from contaminating the section to be coated by an influence of a gas.

After the coating container is used, as shown in FIG. 1, the cap member 44 is fixed again to the mouth part 14 of the container body 12.

At this time, by rotating the outer cap member 48 in a fastening direction (that is, in a direction of an arrow D shown in FIG. 6), as shown in FIG. 3, the guiding member 74 of the outer cap member 48 is moved in the direction of fastening the outer cap member 48, that is, in a direction of an arrow D shown in FIG. 3. Consequently, the guiding member 74 is guided and moved to the upper end position of the guiding groove 72 of the inner cap member 46.

In this state, the outer cap member 48 is located in the direction of separating from the inner cap member 46 in the axial direction. That is, as shown in FIG. 1, the outer cap member 48 is located in the upper direction of the inner cap member 46.

In this state, by further rotating the outer cap member 48 in a fastening direction (that is, in a direction of an arrow D shown in FIG. 6), the guiding member 74 of the outer cap member 48 is locked to the end portion 72*a* of the guiding groove 72 in the state as shown in FIG. 3.

More specifically, in the state in which the outer cap member 48 is locked to the inner cap member 46, in the case in which the outer cap member 48 is further rotated in a fastening direction, the screw portion 52 of the inner cap member 46 is screwed to the screw portion 54 formed on the outer periphery of the mouth part 14 of the container body 12, and the outer cap member 48 and the inner cap member 46 can be fixed to the mouth part 14 of the container body 12 in an integrated manner.

In the state in which the fixing is in mid-course or is completed, as shown in FIG. 1, the abutting portion 68 of the outer cap member 48 is moved upwards close to the inlet of the discharge hole 34 of the inside plug member 18, and the abutting portion 68 is located at a position separated from the leading end portion 32 of the valve element 30, thereby keeping the plug closed state as described above.

Figure 9:
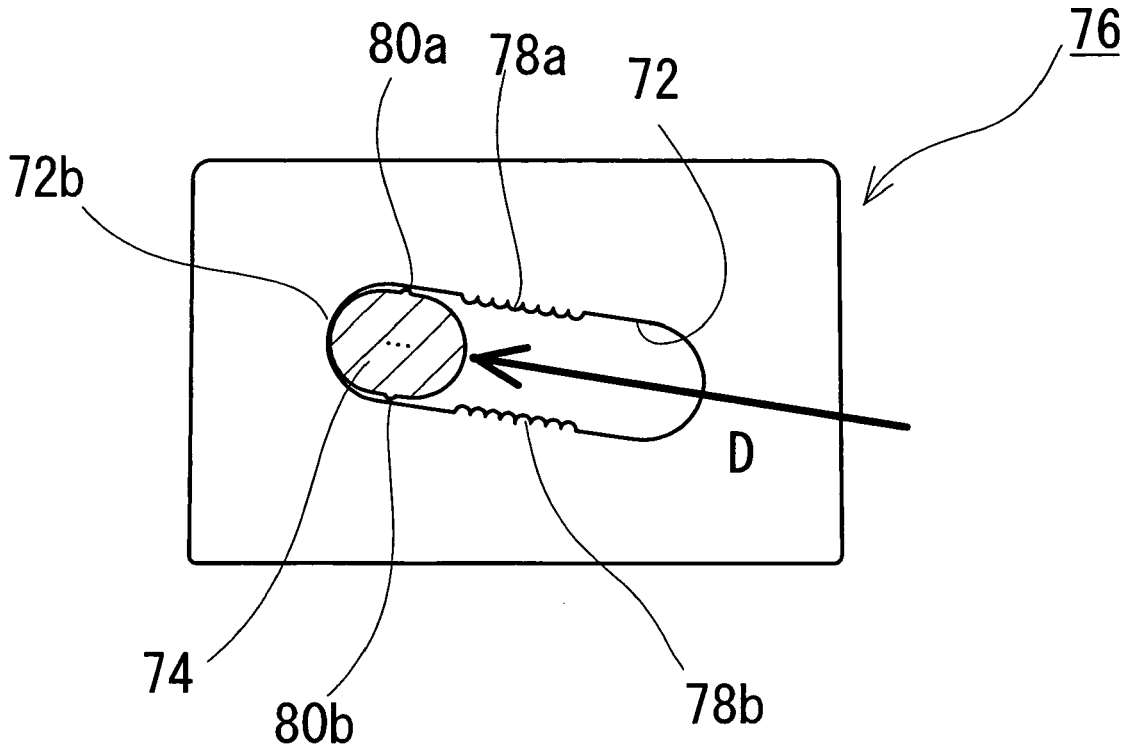
FIG. 9 is a schematic view showing a section B of FIG. 1 for illustrating a guiding means for the coating container in accordance with another embodiment of the present invention similarly to FIG. 3.
Figure 10:
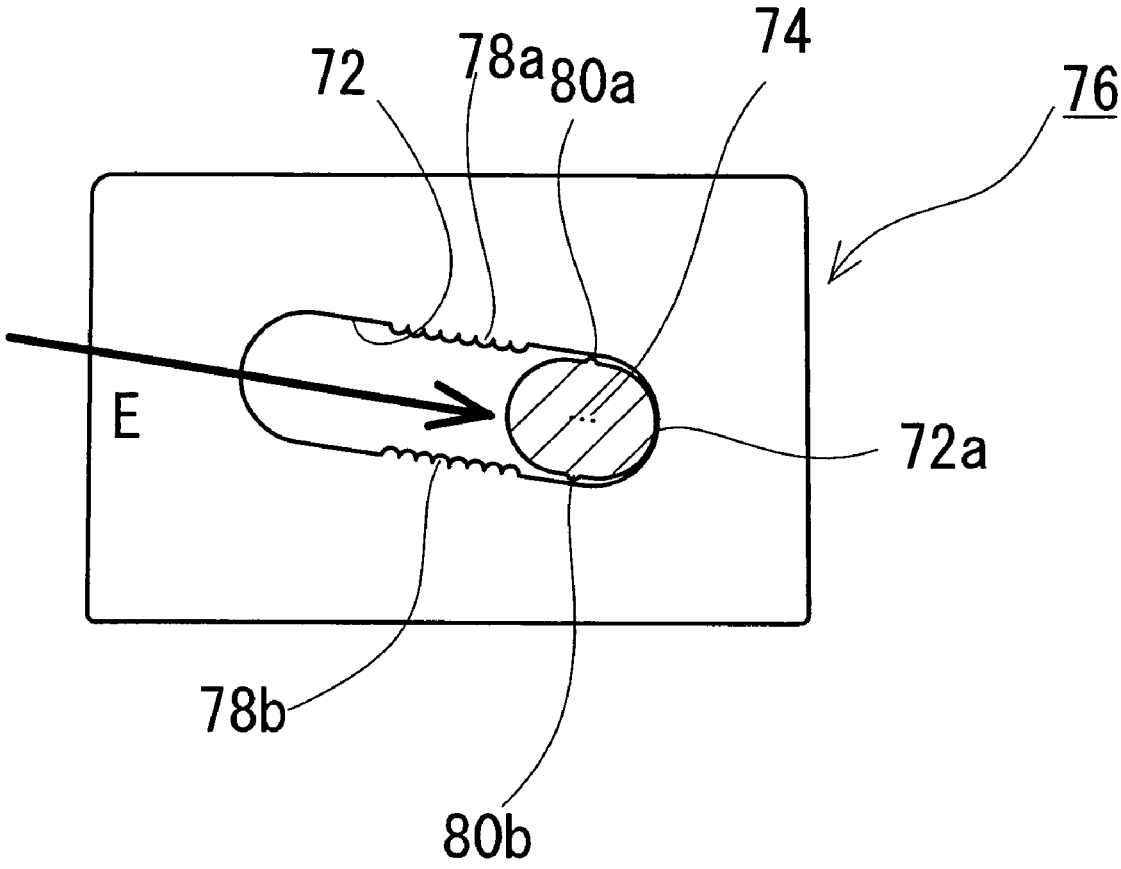
FIG. 10 is a schematic view showing a section B of FIG. 1 for illustrating a guiding means for the coating container in accordance with another embodiment of the present invention similarly to FIG. 4.

FIG. 9 is a schematic view showing a section B of FIG. 1 for illustrating a guiding means for the coating container in accordance with another embodiment of the present invention similarly to FIG. 3. FIG. 10 is a schematic view showing a section B of FIG. 1 for illustrating a guiding means for the coating container in accordance with another embodiment of the present invention similarly to FIG. 4.

Here, a coating container 10 in accordance with the present embodiment has a configuration basically equivalent to that of the coating container 10 shown in FIGS. 1 to 5, and elements equivalent to those illustrated in FIGS. 1 to 5 are numerically numbered similarly and the detailed descriptions of the equivalent elements are omitted.

As shown in FIGS. 9 and 10, the coating container 10 in accordance with the present embodiment is provided with a vibration imparting means 76 for vibrating the outer cap member 48 in the case in which the outer cap member 48 is guided to be movable in the axial direction with respect to the inner cap member 46.

That is, the vibration imparting means 76 is formed at the contact section of the outer cap member 48 and the inner cap member 46.

More specifically, the vibration imparting means 76 includes the minute concave and convex portions 78*a* and 78*b* formed on the both sides of the guiding groove 72 and the minute protruding portions 80*a* and 80*b* in a rib shape formed on the both sides of the guiding member 74 for being guided on the concave and convex portions 78*a* and 78*b* in a sliding manner.

By the above configuration, the protruding portions 80*a* and 80*b* formed on the guiding member 74 are guided in a sliding manner on the concave and convex portions 78*a* and 78*b* formed on the guiding groove 72. Consequently, the outer cap member 48 can be reliably vibrated, and a vibration can be reliably transmitted to the spring portion 28 that is an urging member for urging the valve element 30 in the case in which the coating container is degassed immediately before the use of the coating container. Therefore, a liquid attached to the spring portion 28 can be made fall in drops in the container body 12, and every last liquid in the container body 12 can be used thoroughly.

The vibration imparting means 76 is formed at the contact section of the outer cap member 48 and the inner cap member 46. However, for instance, as shown by an arrow G in FIG. 1, the vibration imparting means 76 can also be formed at the contact section of the inside wall 64*a* formed above the side peripheral wall 64 of the outer cap member 48 and the flange portion 58 formed on the top wall 56 of the inner cap member 46. In addition, as shown by an arrow H in FIG. 1, the vibration imparting means 76 can also be formed at the contact section of the inside wall 64*b* of a base end portion of the side peripheral wall 64 at the lower side of the outer cap member 48 and the outside wall 50*a* of the lower side peripheral wall 50 of the inner cap member 46.

Figure 11:
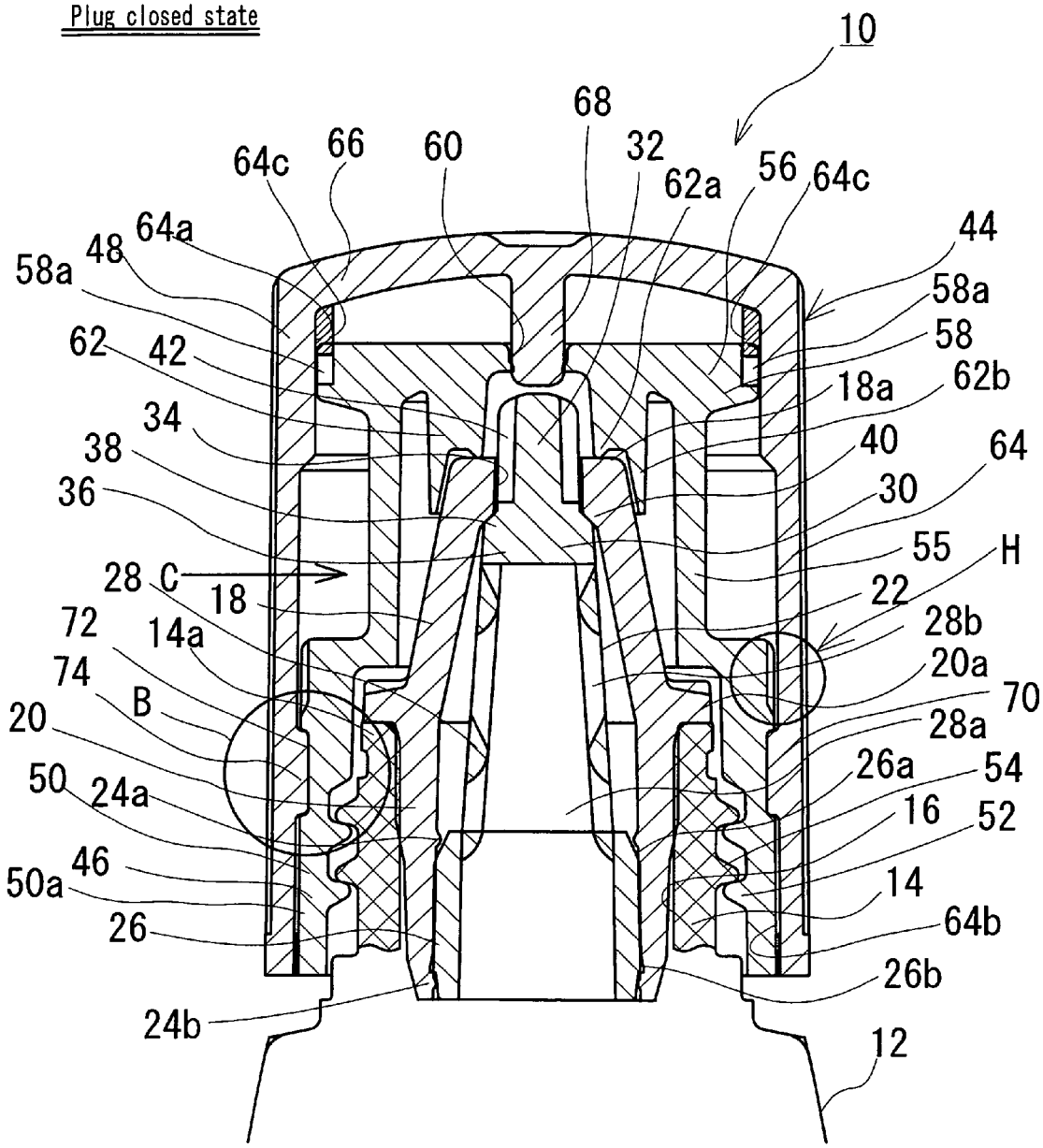
FIG. 11 is a partially enlarged vertical cross-sectional view showing a plug closed state of a coating container in accordance with another embodiment of the present invention similarly to FIG. 1.
Figure 12:
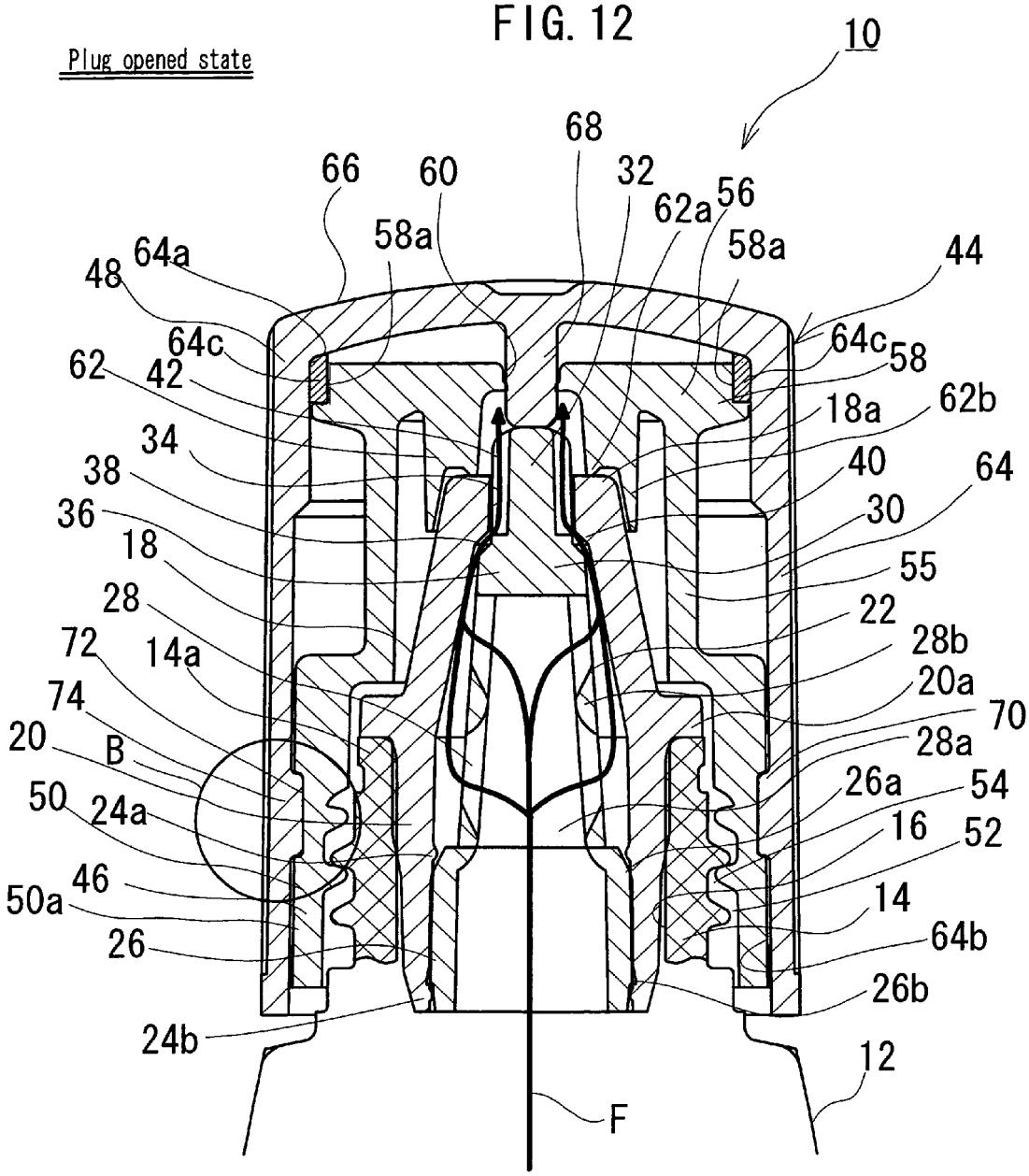
FIG. 12 is a partially enlarged vertical cross-sectional view showing a plug opened state of the coating container of FIG. 11 similarly to FIG. 2.
Figure 13:
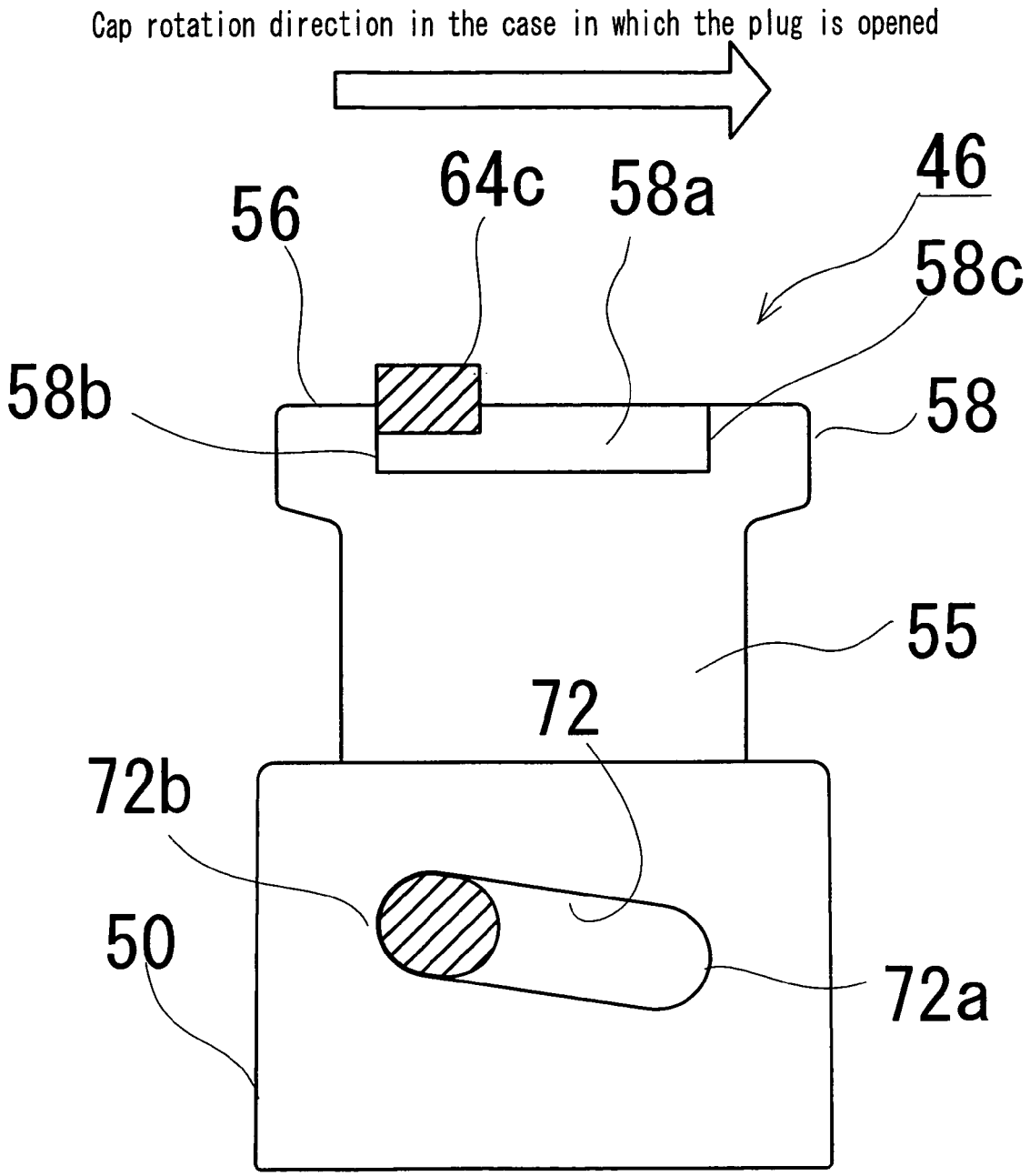
FIG. 13 is a schematic view for illustrating a plug closed state of the coating container of FIG. 11.
Figure 14:
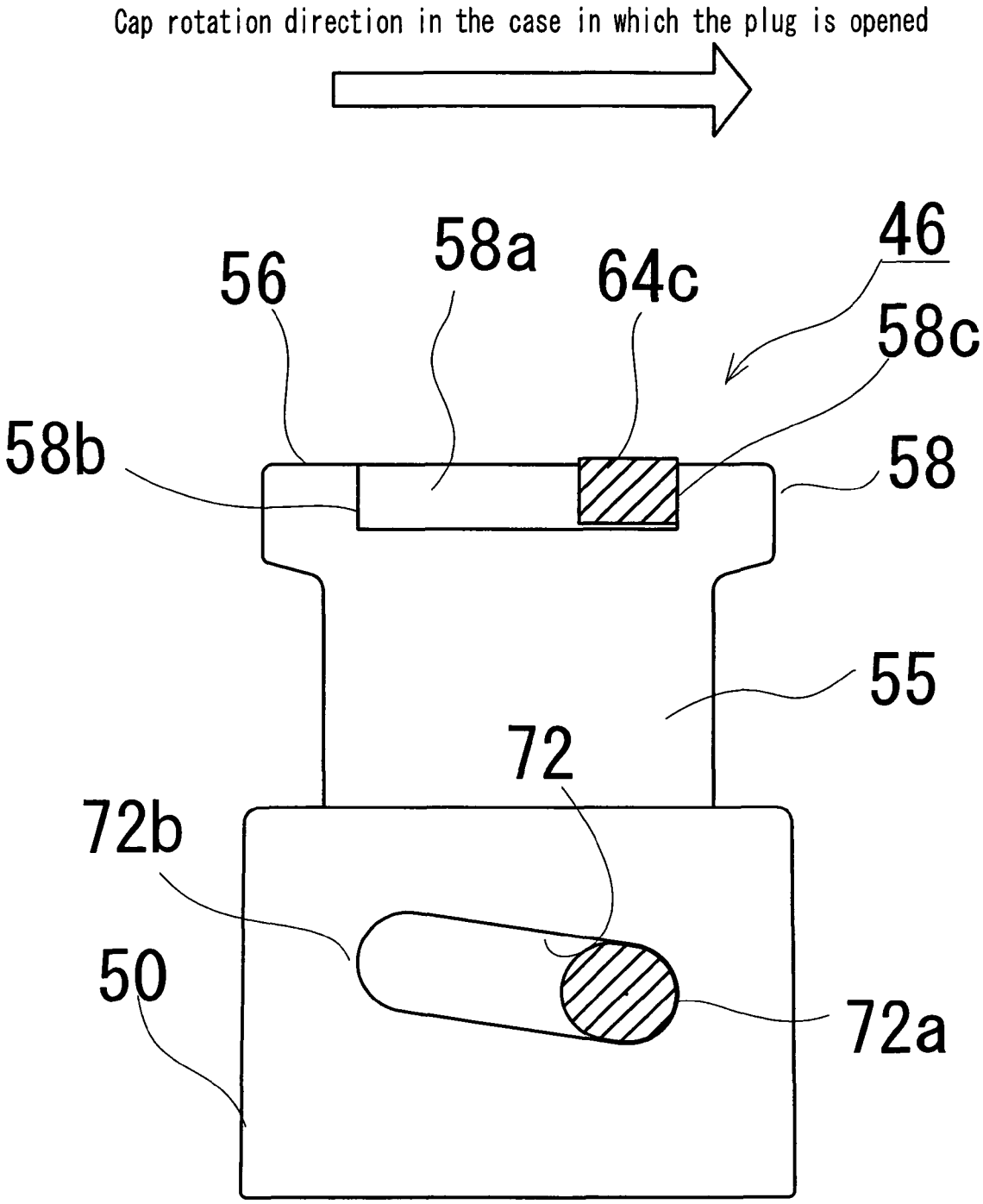
FIG. 14 is a schematic view for illustrating a plug opened state of the coating container of FIG. 11.

FIG. 11 is a partially enlarged vertical cross-sectional view showing a plug closed state of a coating container in accordance with another embodiment of the present invention similarly to FIG. 1. FIG. 12 is a partially enlarged vertical cross-sectional view showing a plug opened state of the coating container of FIG. 11 similarly to FIG. 2. FIG. 13 is a schematic view for illustrating a plug closed state of the coating container of FIG. 11. FIG. 14 is a schematic view for illustrating a plug opened state of the coating container of FIG. 11.

Here, a coating container 10 in accordance with the present embodiment has a configuration basically equivalent to that of the coating container 10 shown in FIGS. 1 to 5, and elements equivalent to those illustrated in FIGS. 1 to 5 are numerically numbered similarly and the detailed descriptions of the equivalent elements are omitted.

As shown in FIGS. 11 to 14, the coating container 10 in accordance with the present embodiment is provided with a free rotation preventing rib 64*c* formed in a protruding manner on the inside wall 64*a* formed above the side peripheral wall 64 of the outer cap member 48 and a free rotation preventing guiding groove 58*a* formed on the outer periphery of the flange portion 58 of the inner cap member 46 to cause the free rotation preventing rib 64*c* to be guided.

By the above configuration, as shown in FIGS. 13 and 14, in the plug closed state and the plug opened state, the free rotation preventing rib 64*c* is locked to an end portion 58*b* and an end portion 58*c*, respectively, of the free rotation preventing guiding groove 58*a*, thereby preventing a free rotation of the outer cap member 48.

While the preferred embodiments of the present invention have been described above, the present invention is not restricted to the embodiments. For instance, although the screw portion 52 of the inner cap member 46 is screwed to the screw portion 54 formed on the outer periphery of the mouth part 14 of the container body 12 in the above embodiment, a so-called snap fit system can also be used although this is not shown in the figure.

Figure 15:
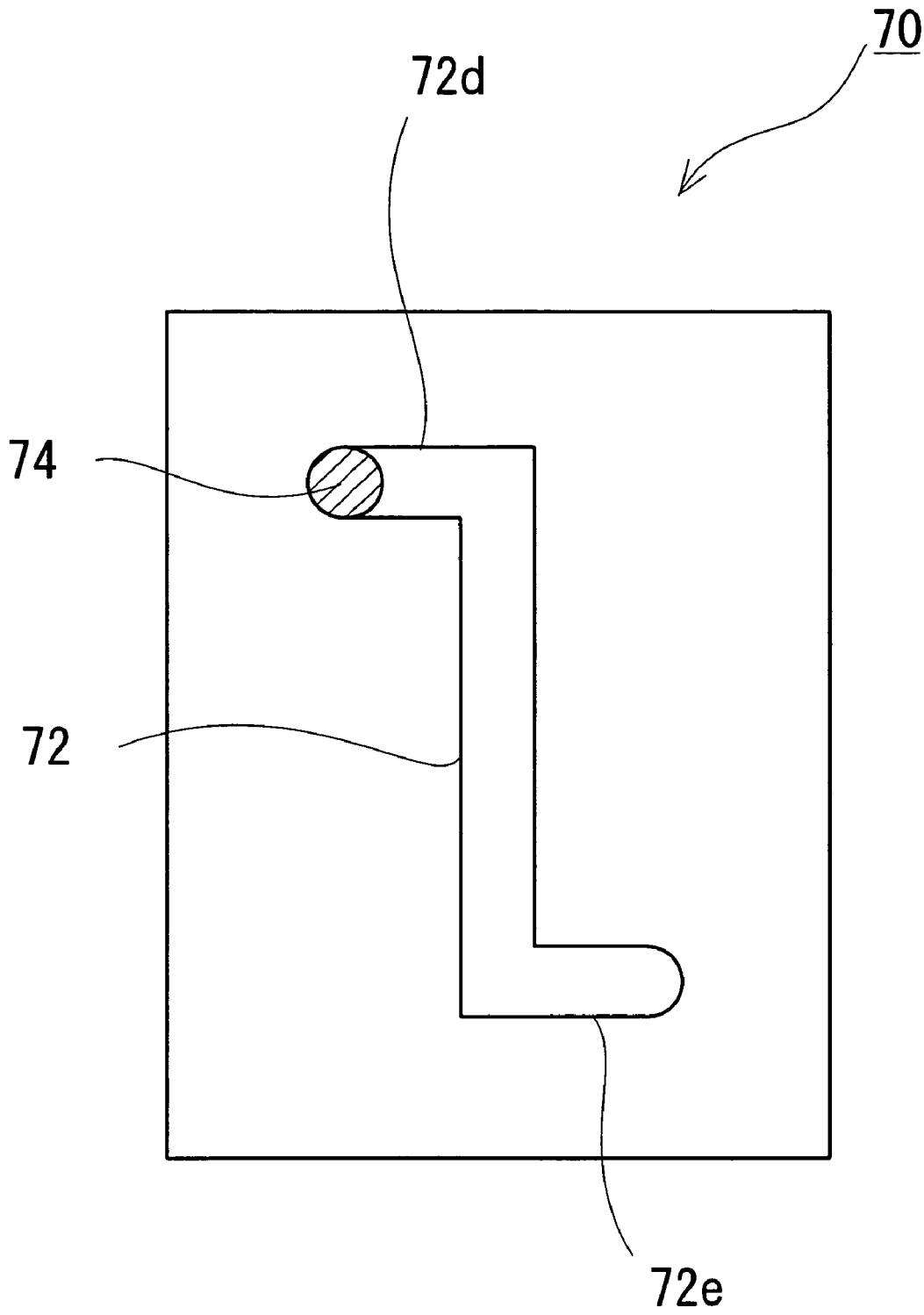
FIG. 15 is a schematic view showing a section B of FIG. 1 for illustrating a means of guiding an outer cap member to be movable in the axial direction with respect to an inner cap member for the coating container in accordance with the present invention.
Figure 16:
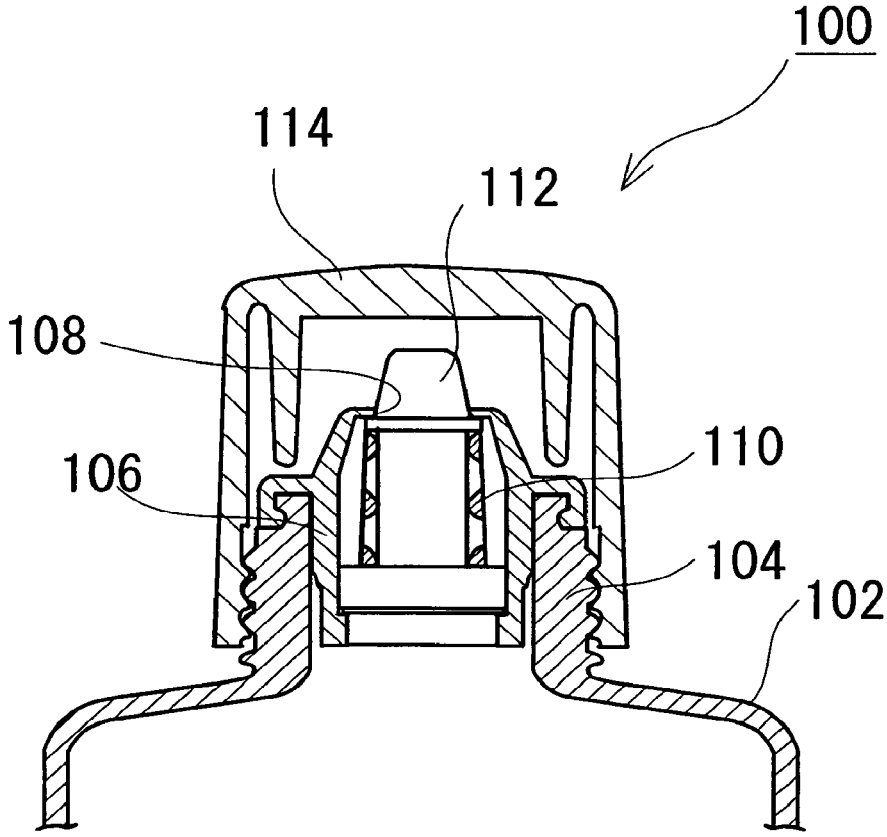
FIG. 16 PRIOR ART
FIG. 16 is a partially enlarged vertical cross-sectional view showing a conventional coating container.
Figure 17:
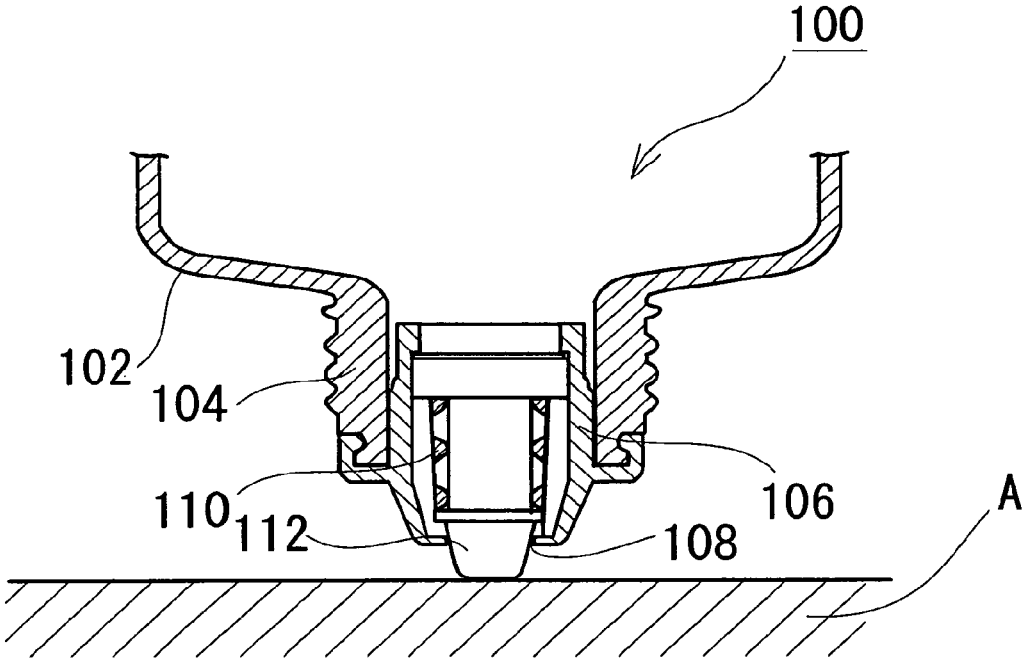
FIG. 17 PRIOR ART
FIG. 17 is a partially enlarged vertical cross-sectional view showing a conventional coating container.
Figure 18:
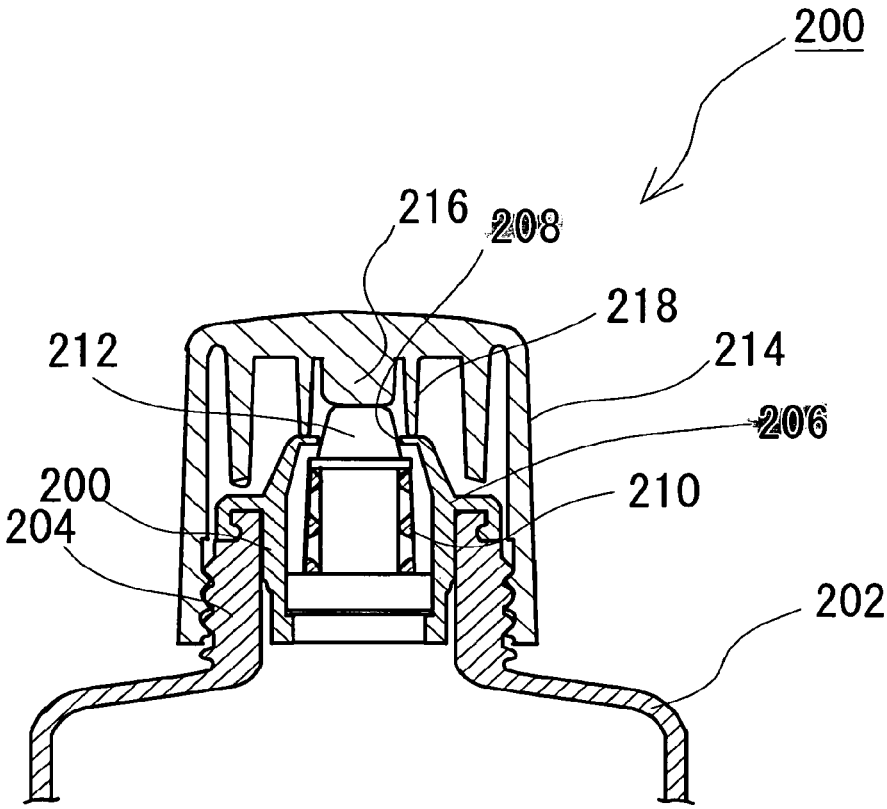
FIG. 18 PRIOR ART
FIG. 18 is a partially enlarged vertical cross-sectional view showing a conventional coating container.
Figure 19:
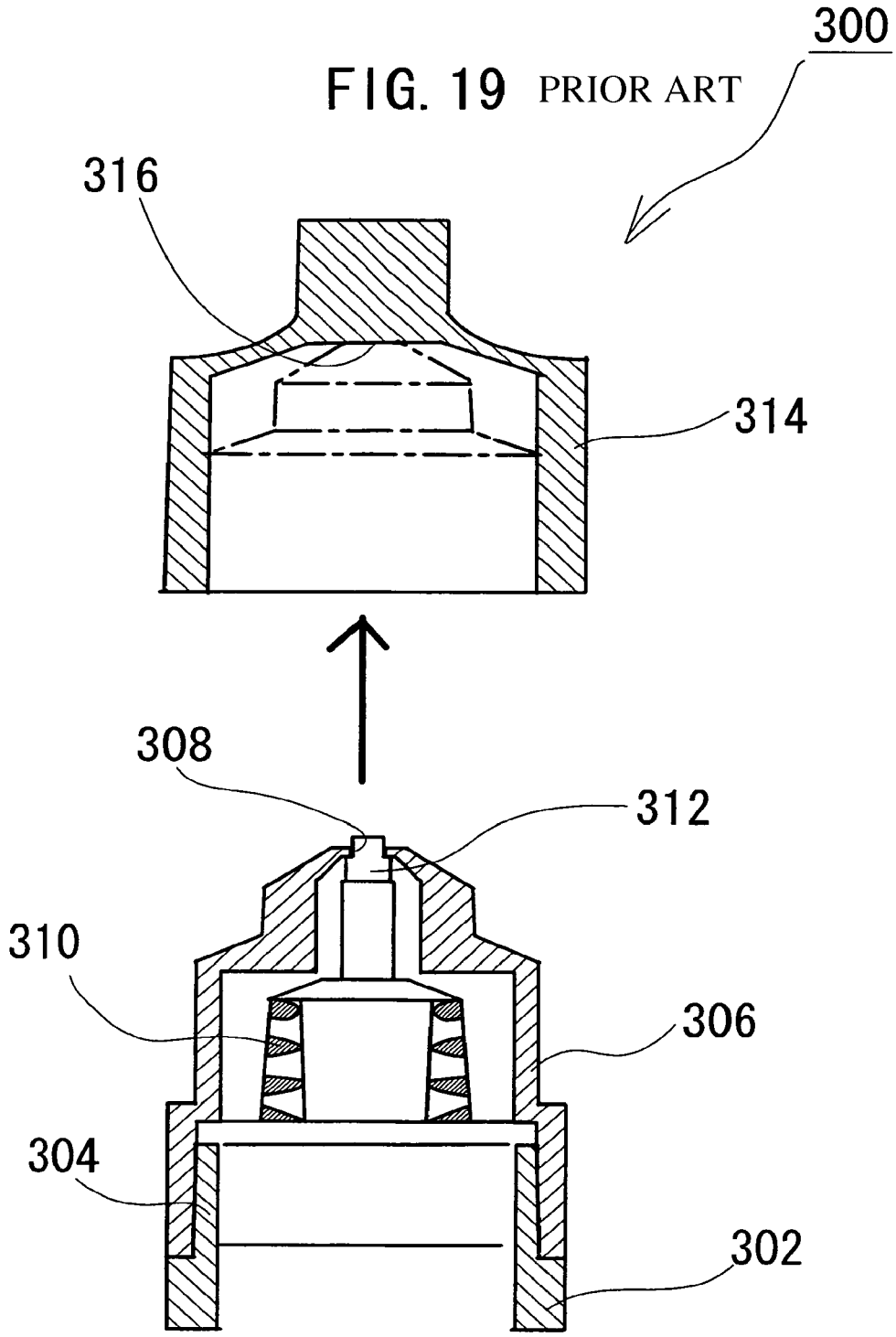
FIG. 19 PRIOR ART
FIG. 19 is a partially enlarged vertical cross-sectional view showing a conventional coating container.
Figure 20:
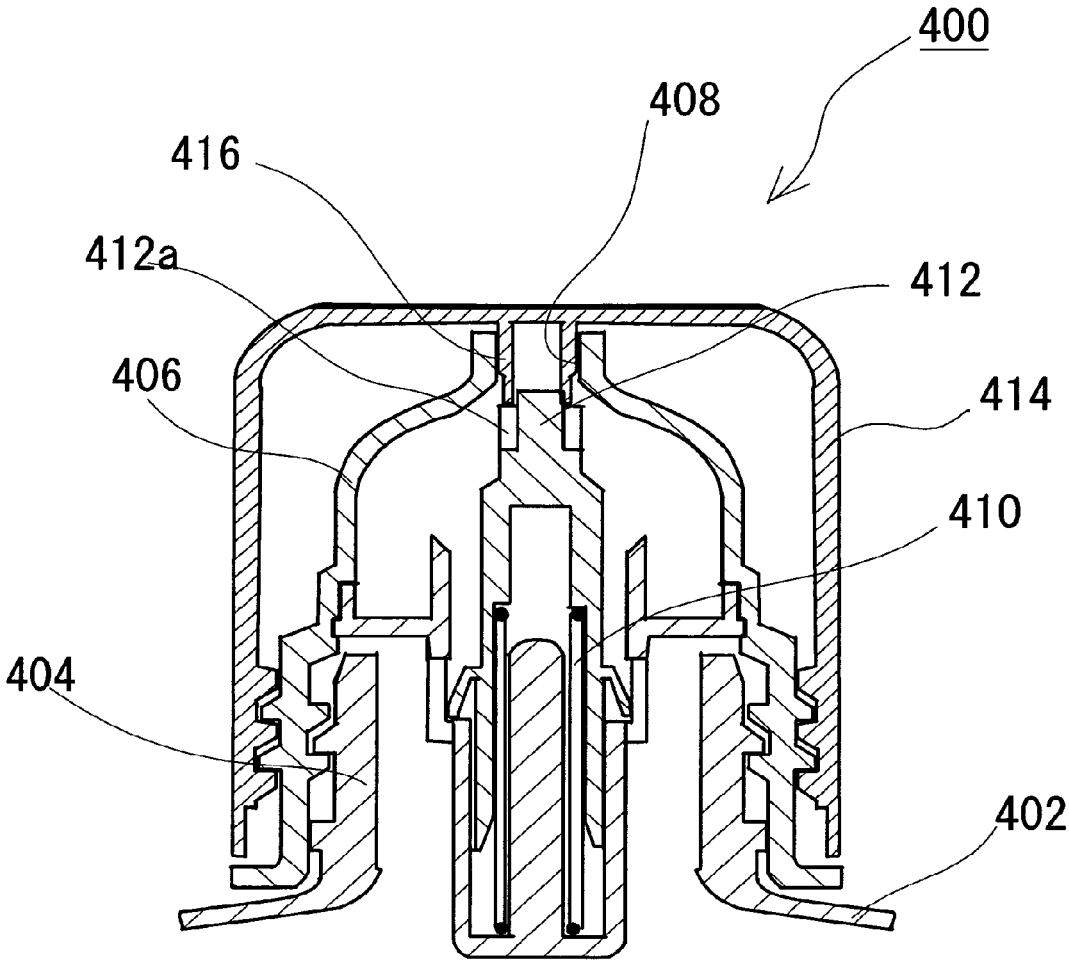
FIG. 20 PRIOR ART
FIG. 20 is a partially enlarged vertical cross-sectional view showing a conventional coating container.

Moreover, although the guiding groove 72 formed in a spiral shape is used in the above embodiment, a guiding groove 72 in the axial direction and locking portions 72*d* and 72*e* perpendicular to the guiding groove 72 can also be formed as shown in FIG. 15. Thus, various changes, modifications, and functional additions can be made without departing from the scope of the present invention.

INDUSTRIAL APPLICABILITY

The present invention relates to a coating container provided with an inside plug member that is fixed to the mouth part of a container body for holding a liquid and that includes a valve element capable of opening and closing a discharge hole by a push system.

The invention claimed is:

1. A coating container comprising:

an inside plug member fixed to a mouth part of a container body and including a leading end;

a valve element disposed at the inside plug member, the valve element being capable of projecting from and withdrawing into a discharge hole formed at the leading end of the inside plug member and being urged in a direction of projecting from the discharge hole by an urging member, such that the discharge hole is opened and closed by a movement of the valve element; and a cap member detachably fixed to the mouth part of the container body, wherein the cap member comprises:

an inner cap member detachably fixed to the mouth part of the container body;

an outer cap member fixed to an outside of the inner cap member; and a guiding means for guiding the outer cap member to be movable in a moving direction of the valve element with respect to the inner cap member, wherein, the outer cap member is movable relatively in the moving direction of the valve element with respect to the inner cap member and is movable between (i) a separating position in which a guiding member of the outer cap member is located in an upper end top position and (ii) an approaching position in which the guiding member of the outer cap member is located in a lower end position, wherein, when the cap member is fixed to the mouth part of the container body, the outer cap member is located in a direction of separating from the inner cap member in the moving direction of the valve element with the guiding member of the outer cap member in the upper end top position, and an inner face of a top wall of the outer cap member is separated from the valve element so as to urge the valve element in a direction of projecting from the discharge hole of the inside plug member, such that the discharge hole is in a closed state, wherein, when the cap member is detached from the mouth part of the container body, the outer cap member is moved in a direction of approaching the inner cap member in the moving direction of the valve element with the guiding member of the outer cap member in the lower end position, and the inner face of the top wall of the outer cap member abuts the valve element so as to urge the valve element in a direction of withdrawing into and separating from the discharge hole of the inside plug member while resisting against an urging force of the urging member, such that the discharge hole is in an opened state, and wherein, when the cap member is detached and separated from the mouth part of the container body, the valve element is urged in the direction of projecting from the discharge hole of the inside plug member by the urging force of the urging member, such that the discharge hole is in the closed state.

2. The coating container as defined in claim 1, wherein:

the cap member is detachably fixed to the mouth part of the container body by rotating the cap member against the mouth part of the container body;

the outer cap member is moved in the direction of approaching the inner cap member by the guiding means by rotating the outer cap member in a detaching direction against the mouth part of the container body;

the outer cap member is locked to the inner cap member after the outer cap member is moved by a predetermined distance in the direction of approaching the inner cap member by the guiding means; and the outer cap member and the inner cap member can be detached from the mouth part of the container body in an integrated manner by further rotating the outer cap member in the detaching direction against the mouth part of the container body.

3. The coating container as defined in claim 1, wherein the guiding means includes a guiding groove formed at the inner cap member and a guiding member formed at the outer cap member and guided in the guiding groove of the inner cap member.

4. The coating container as defined in claim 3, wherein:

the guiding groove formed at the inner cap member is formed in a spiral shape on an outside wall of a side peripheral part of the inner cap member; and the guiding member formed at the outer cap member is formed in a protruding manner to an inside direction on an inside wall of a side peripheral part of the outer cap member.

5. The coating container as defined in claim 1, wherein the guiding means includes a guiding groove formed at the outer cap member and a guiding member formed at the inner cap member and guided in the guiding groove of the outer cap member.

6. The coating container as defined in claim 5, wherein:

the guiding groove formed at the outer cap member is formed in a spiral shape on an inside wall of a side peripheral part of the outer cap member; and the guiding member formed at the inner cap member is formed in a protruding manner to an outside direction on an outside wall of a side peripheral part of the inner cap member.

7. The coating container as defined in claim 1, wherein an abutting portion is formed on the inner face of the top wall of the outer cap member for being abutted to the valve element.

8. The coating container as defined in claim 1, further comprising a vibration imparting means for vibrating the outer cap member when the outer cap member is guided to be movable in the moving direction of the valve element with respect to the inner cap member.

9. The coating container as defined in claim 8, wherein the vibration imparting means is formed at a contact section of the outer cap member and the inner cap member.

10. The coating container as defined in claim 9, wherein the vibration imparting means includes a concave and convex portion formed at a guiding groove and a protruding portion formed on a guiding member for being guided on the concave and convex portion in a sliding manner.

11. The coating container as defined in claim 1, wherein the valve element and the urging member are formed in an integrated manner.

12. The coating container as defined in claim 1, wherein at least one groove for discharge is formed on a leading end portion of the valve element.

* * * * *